US008947465B2

(12) United States Patent
Kerofsky

(10) Patent No.: US 8,947,465 B2
(45) Date of Patent: Feb. 3, 2015

(54) METHODS AND SYSTEMS FOR DISPLAY-MODE-DEPENDENT BRIGHTNESS PRESERVATION

(75) Inventor: Louis Joseph Kerofsky, Camas, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 2432 days.

(21) Appl. No.: 11/293,066

(22) Filed: Dec. 2, 2005

(65) Prior Publication Data

US 2006/0119613 A1 Jun. 8, 2006

Related U.S. Application Data

(63) Continuation-in-part of application No. 11/224,792, filed on Sep. 12, 2005, now Pat. No. 7,961,199, which is a continuation-in-part of application No. 11/154,053, filed on Jun. 15, 2005, and a (Continued)

(51) Int. Cl.

| | |
|---|---|
| ***G09G 5/00*** | (2006.01) |
| ***G09G 3/22*** | (2006.01) |
| ***G09G 3/34*** | (2006.01) |

(52) U.S. Cl.

CPC ..... *G09G 3/22* (2013.01); *G09G 2320/0276* (2013.01); *G09G 3/3406* (2013.01); *G09G 2320/0271* (2013.01);

(Continued)

(58) Field of Classification Search

CPC ..... G09G 3/22; G09G 3/3406; G09G 2320/0271; G09G 2320/0276; G09G 2320/0626; G09G 2320/0646; G09G 2320/0653; G09G 2330/021; G09G 2360/16

USPC ..... 345/590, 102, 89, 211, 690; 382/167, 382/260–274

See application file for complete search history.

(56) References Cited

U.S. PATENT DOCUMENTS

| | | |
|---|---|---|
| 4,020,462 A | 4/1977 | Morrin |
| 4,196,452 A | 4/1980 | Warren et al. |

(Continued)

FOREIGN PATENT DOCUMENTS

| | | |
|---|---|---|
| EP | 0841652 | 5/1998 |
| EP | 963112 | 12/1999 |

(Continued)

OTHER PUBLICATIONS

A. Iranli, W. Lee, and M. Pedram, "HVS-Aware Dynamic Backlight Scaling in TFT LCD's", Very Large Scale Integration (VLSI) Systems, IEEE Transactions vol. 14 No. 10 pp. 1103-1116, 2006.

(Continued)

*Primary Examiner* — Jin-Cheng Wang

(74) *Attorney, Agent, or Firm* — Chernoff Vilhauer McClung & Stenzel, LLP

(57) ABSTRACT

Embodiments of the present invention comprise systems, methods and devices for display-mode-dependent adjustment of image code values.

21 Claims, 13 Drawing Sheets

Related U.S. Application Data continuation-in-part of application No. 11/154,054, filed on Jun. 15, 2005, and a continuation-in-part of application No. 11/154,052, filed on Jun. 15, 2005, now Pat. No. 7,800,577.

(60) Provisional application No. 60/660,049, filed on Mar. 9, 2005, provisional application No. 60/670,749, filed on Apr. 11, 2005, provisional application No. 60/632,776, filed on Dec. 2, 2004, provisional application No. 60/632,779, filed on Dec. 2, 2004, provisional application No. 60/710,927, filed on Aug. 23, 2005.

(52) U.S. Cl.

CPC ..... *G09G 2320/0626* (2013.01); *G09G 2320/0646* (2013.01); *G09G 2320/0653* (2013.01); *G09G 2330/021* (2013.01); *G09G 2360/16* (2013.01)

USPC ..... 345/690; 345/589; 345/590; 345/83; 345/88; 345/102; 345/204; 345/207; 345/208; 345/211; 345/596; 345/598; 382/168; 382/169; 382/263; 382/264; 382/274; 348/E5.062; 348/E5.096; 348/E5.101; 348/E5.127; 348/563; 348/671; 348/673; 348/687; 348/700; 348/730; 348/734; 348/790; 348/806

(56) References Cited

U.S. PATENT DOCUMENTS

| | | | | |
|---|---|---|---|---|
| 4,223,340 | A | 9/1980 | Bingham et al. | |
| 4,268,864 | A | 5/1981 | Green | |
| 4,399,461 | A | 8/1983 | Powell | |
| 4,402,006 | A | 8/1983 | Karlock | |
| 4,523,230 | A | 6/1985 | Harlan | |
| 4,536,796 | A | 8/1985 | Harlan | |
| 4,549,212 | A | 10/1985 | Bayer | |
| 4,553,165 | A | 11/1985 | Bayer | |
| 4,709,262 | A | 11/1987 | Spieth et al. | |
| 4,847,603 | A | 7/1989 | Blanchard | |
| 4,962,426 | A | 10/1990 | Naoi et al. | |
| 5,025,312 | A | 6/1991 | Faroudja | |
| 5,046,834 | A | 9/1991 | Dietrich | |
| 5,081,529 | A | 1/1992 | Collette | |
| 5,176,224 | A | 1/1993 | Spector | |
| 5,218,649 | A | 6/1993 | Kundu et al. | |
| 5,227,869 | A | 7/1993 | Degawa | |
| 5,235,434 | A | 8/1993 | Wober | |
| 5,260,791 | A | 11/1993 | Lubin | |
| 5,270,818 | A | 12/1993 | Ottenstein | |
| 5,389,978 | A | 2/1995 | Jeong-Hun | |
| 5,526,446 | A | 6/1996 | Adelson | |
| 5,528,257 | A | 6/1996 | Okumura et al. | |
| 5,651,078 | A | 7/1997 | Chan | |
| 5,696,852 | A | 12/1997 | Minoura et al. | |
| 5,760,760 | A | 6/1998 | Helms | |
| 5,808,697 | A | 9/1998 | Fujimura et al. | |
| 5,857,033 | A | 1/1999 | Kim | |
| 5,912,992 | A | 6/1999 | Sawada et al. | |
| 5,920,653 | A | 7/1999 | Silverstein | |
| 5,952,992 | A | 9/1999 | Helms | |
| 5,956,014 | A | 9/1999 | Kuriyama et al. | |
| 6,055,340 | A | 4/2000 | Nagao | |
| 6,075,563 | A | 6/2000 | Hung | |
| 6,275,207 | B1 | 8/2001 | Nitta et al. | |
| 6,278,421 | B1 | 8/2001 | Ishida et al. | |
| 6,285,798 | B1 * | 9/2001 | Lee | 382/260 |
| 6,317,521 | B1 | 11/2001 | Gallagher et al. | |
| 6,424,730 | B1 | 7/2002 | Wang et al. | |
| 6,445,835 | B1 | 9/2002 | Qian | |
| 6,504,953 | B1 | 1/2003 | Behrends | |
| 6,507,668 | B1 | 1/2003 | Park | |
| 6,516,100 | B1 | 2/2003 | Qian | |
| 6,546,741 | B2 | 4/2003 | Yun et al. | |
| 6,560,018 | B1 | 5/2003 | Swanson | |
| 6,573,961 | B2 | 6/2003 | Jiang et al. | |
| 6,583,579 | B2 | 6/2003 | Tsumura | |
| 6,593,934 | B1 | 7/2003 | Liaw et al. | |
| 6,594,388 | B1 * | 7/2003 | Gindele et al. | 382/167 |
| 6,600,470 | B1 | 7/2003 | Tsuda | |
| 6,618,042 | B1 | 9/2003 | Powell | |
| 6,618,045 | B1 | 9/2003 | Lin | |
| 6,628,823 | B1 | 9/2003 | Holm | |
| 6,677,959 | B1 | 1/2004 | James | |
| 6,728,416 | B1 | 4/2004 | Gallagher | |
| 6,753,835 | B1 | 6/2004 | Sakai | |
| 6,782,137 | B1 | 8/2004 | Avinash | |
| 6,788,280 | B2 | 9/2004 | Ham | |
| 6,795,063 | B2 | 9/2004 | Endo et al. | |
| 6,809,717 | B2 | 10/2004 | Asao | |
| 6,809,718 | B2 | 10/2004 | Wei et al. | |
| 6,816,141 | B1 | 11/2004 | Fergason | |
| 6,816,156 | B2 | 11/2004 | Sukeno et al. | |
| 6,934,772 | B2 | 8/2005 | Bui et al. | |
| 7,006,688 | B2 | 2/2006 | Zaklika et al. | |
| 7,010,160 | B1 | 3/2006 | Yoshida | |
| 7,068,328 | B1 | 6/2006 | Mino | |
| 7,088,388 | B2 | 8/2006 | MacLean et al. | |
| 7,098,927 | B2 | 8/2006 | Daly et al. | |
| 7,110,062 | B1 | 9/2006 | Whitted et al. | |
| 7,142,218 | B2 | 11/2006 | Yoshida | |
| 7,142,712 | B2 | 11/2006 | Maruoka et al. | |
| 7,158,686 | B2 * | 1/2007 | Gindele | 382/274 |
| 7,199,776 | B2 | 4/2007 | Ikeda et al. | |
| 7,202,458 | B2 | 4/2007 | Park | |
| 7,221,408 | B2 | 5/2007 | Kim | |
| 7,253,814 | B2 | 8/2007 | Kim et al. | |
| 7,259,769 | B2 | 8/2007 | Diefenbaugh | |
| 7,287,860 | B2 | 10/2007 | Yoshida et al. | |
| 7,289,154 | B2 | 10/2007 | Gindele | |
| 7,317,439 | B2 | 1/2008 | Hata et al. | |
| 7,330,287 | B2 | 2/2008 | Sharman | |
| 7,352,347 | B2 | 4/2008 | Fergason | |
| 7,352,352 | B2 | 4/2008 | Oh et al. | |
| 7,394,448 | B2 | 7/2008 | Park et al. | |
| 7,403,318 | B2 | 7/2008 | Miyazawa et al. | |
| 7,433,096 | B2 * | 10/2008 | Chase et al. | 358/504 |
| 7,443,377 | B2 | 10/2008 | Kim | |
| 7,532,239 | B2 | 5/2009 | Hayaishi | |
| 7,564,438 | B2 | 7/2009 | Kao et al. | |
| 7,639,220 | B2 | 12/2009 | Yoshida et al. | |
| 2001/0031084 | A1 | 10/2001 | Cannata et al. | |
| 2002/0008784 | A1 | 1/2002 | Shirata et al. | |
| 2002/0057238 | A1 | 5/2002 | Nitta | |
| 2002/0167629 | A1 | 11/2002 | Blanchard | |
| 2002/0181797 | A1 | 12/2002 | Young | |
| 2003/0001815 | A1 | 1/2003 | Cui | |
| 2003/0012437 | A1 | 1/2003 | Zaklika et al. | |
| 2003/0051179 | A1 | 3/2003 | Tsirkel et al. | |
| 2003/0053690 | A1 | 3/2003 | Trifonov et al. | |
| 2003/0058464 | A1 * | 3/2003 | Loveridge et al. | 358/1.9 |
| 2003/0146919 | A1 | 8/2003 | Kawashima | |
| 2003/0169248 | A1 | 9/2003 | Kim | |
| 2003/0179213 | A1 | 9/2003 | Liu | |
| 2003/0193472 | A1 | 10/2003 | Powell | |
| 2003/0201968 | A1 | 10/2003 | Itoh | |
| 2003/0223634 | A1 | 12/2003 | Gallagher et al. | |
| 2003/0227577 | A1 | 12/2003 | Allen et al. | |
| 2003/0235342 | A1 * | 12/2003 | Gindele | 382/260 |
| 2004/0001184 | A1 | 1/2004 | Gibbons et al. | |
| 2004/0081363 | A1 * | 4/2004 | Gindele et al. | 382/260 |
| 2004/0095531 | A1 | 5/2004 | Jiang et al. | |
| 2004/0113905 | A1 | 6/2004 | Mori et al. | |
| 2004/0113906 | A1 | 6/2004 | Lew | |
| 2004/0119950 | A1 | 6/2004 | Penn | |
| 2004/0130556 | A1 | 7/2004 | Nokiyama | |
| 2004/0160435 | A1 | 8/2004 | Cui et al. | |
| 2004/0170316 | A1 | 9/2004 | Saquib | |
| 2004/0198468 | A1 | 10/2004 | Patel et al. | |
| 2004/0201562 | A1 | 10/2004 | Funamoto | |
| 2004/0207609 | A1 | 10/2004 | Hata | |
| 2004/0207635 | A1 | 10/2004 | Miller et al. | |
| 2004/0208363 | A1 | 10/2004 | Berge et al. | |
| 2004/0239612 | A1 | 12/2004 | Asao | |

(56) References Cited

U.S. PATENT DOCUMENTS

| | | | | |
|---|---|---|---|---|
| 2004/0257324 | A1* | 12/2004 | Hsu | 345/89 |
| 2005/0001801 | A1 | 1/2005 | Kim | |
| 2005/0057484 | A1 | 3/2005 | Diefenbaugh et al. | |
| 2005/0104837 | A1 | 5/2005 | Baik et al. | |
| 2005/0104839 | A1 | 5/2005 | Baik | |
| 2005/0104840 | A1 | 5/2005 | Sohn et al. | |
| 2005/0104841 | A1 | 5/2005 | Sohn et al. | |
| 2005/0117186 | A1* | 6/2005 | Li et al. | 359/15 |
| 2005/0117798 | A1 | 6/2005 | Patton et al. | |
| 2005/0140616 | A1 | 6/2005 | Sohn et al. | |
| 2005/0140639 | A1 | 6/2005 | Oh et al. | |
| 2005/0147317 | A1 | 7/2005 | Daly et al. | |
| 2005/0152614 | A1 | 7/2005 | Daly et al. | |
| 2005/0184952 | A1 | 8/2005 | Konno | |
| 2005/0190142 | A1 | 9/2005 | Ferguson | |
| 2005/0195212 | A1 | 9/2005 | Kurumisawa | |
| 2005/0200868 | A1 | 9/2005 | Yoshida | |
| 2005/0212972 | A1 | 9/2005 | Suzuki | |
| 2005/0232482 | A1 | 10/2005 | Ikeda et al. | |
| 2005/0244053 | A1 | 11/2005 | Hayaishi | |
| 2005/0248503 | A1 | 11/2005 | Schobben et al. | |
| 2005/0248593 | A1* | 11/2005 | Feng et al. | 345/690 |
| 2005/0270265 | A1 | 12/2005 | Plut | |
| 2006/0012987 | A9 | 1/2006 | Ducharme et al. | |
| 2006/0015758 | A1 | 1/2006 | Yoon | |
| 2006/0061563 | A1* | 3/2006 | Fleck | 345/211 |
| 2006/0072158 | A1 | 4/2006 | Christie | |
| 2006/0077405 | A1* | 4/2006 | Topfer et al. | 358/1.9 |
| 2006/0119612 | A1 | 6/2006 | Kerofsky et al. | |
| 2006/0120489 | A1 | 6/2006 | Lee | |
| 2006/0146236 | A1 | 7/2006 | Wu et al. | |
| 2006/0174105 | A1 | 8/2006 | Park | |
| 2006/0209005 | A1 | 9/2006 | Pedram et al. | |
| 2006/0221046 | A1 | 10/2006 | Sato | |
| 2006/0238827 | A1 | 10/2006 | Ikeda | |
| 2006/0256840 | A1 | 11/2006 | Alt | |
| 2006/0284822 | A1 | 12/2006 | Kerofsky | |
| 2006/0284823 | A1 | 12/2006 | Kerofsky | |
| 2006/0284882 | A1 | 12/2006 | Kerofsky | |
| 2007/0001997 | A1 | 1/2007 | Kim et al. | |
| 2007/0002004 | A1 | 1/2007 | Woo | |
| 2007/0018951 | A1 | 1/2007 | Nobori et al. | |
| 2007/0092139 | A1 | 4/2007 | Daly | |
| 2007/0097069 | A1 | 5/2007 | Kurokawa | |
| 2007/0103418 | A1 | 5/2007 | Ogino | |
| 2007/0126757 | A1 | 6/2007 | Itoh | |
| 2007/0146236 | A1 | 6/2007 | Kerofsky et al. | |
| 2007/0268524 | A1 | 11/2007 | Nose | |
| 2008/0037867 | A1 | 2/2008 | Lee | |
| 2008/0055228 | A1 | 3/2008 | Glen | |
| 2008/0074372 | A1 | 3/2008 | Baba | |
| 2008/0094426 | A1 | 4/2008 | Kimpe | |
| 2008/0180373 | A1 | 7/2008 | Mori | |
| 2008/0208551 | A1 | 8/2008 | Kerofsky et al. | |
| 2008/0231581 | A1 | 9/2008 | Fujine | |
| 2008/0238840 | A1 | 10/2008 | Raman et al. | |
| 2009/0002285 | A1 | 1/2009 | Baba | |
| 2009/0015602 | A1 | 1/2009 | Rumreich et al. | |
| 2009/0051714 | A1 | 2/2009 | Ohhara | |
| 2009/0167658 | A1 | 7/2009 | Yamane et al. | |
| 2009/0167673 | A1 | 7/2009 | Kerofsky et al. | |
| 2009/0174636 | A1 | 7/2009 | Kohashikawa et al. | |

FOREIGN PATENT DOCUMENTS

| | | |
|---|---|---|
| EP | 1788550 | 5/2007 |
| FR | 2782566 | 2/2000 |
| JP | 3102579 | 4/1991 |
| JP | 3284791 | 12/1991 |
| JP | 8009154 | 1/1996 |
| JP | 11194317 | 7/1999 |
| JP | 200056738 | 2/2000 |
| JP | 2000148072 | 5/2000 |
| JP | 2000259118 | 9/2000 |
| JP | 2001057650 | 2/2001 |
| JP | 2001083940 | 3/2001 |
| JP | 2001086393 | 3/2001 |
| JP | 2001298631 | 10/2001 |
| JP | 2001350134 | 12/2001 |
| JP | 2002189450 | 7/2002 |
| JP | 2003259383 | 9/2003 |
| JP | 2003271106 | 9/2003 |
| JP | 2003316318 | 11/2003 |
| JP | 2004007076 | 1/2004 |
| JP | 2004020991 A | 1/2004 |
| JP | 200445634 | 2/2004 |
| JP | 2004129265 A | 4/2004 |
| JP | 2004133577 | 4/2004 |
| JP | 2004177547 | 6/2004 |
| JP | 2004272156 | 9/2004 |
| JP | 2004287420 | 10/2004 |
| JP | 2004325628 | 11/2004 |
| JP | 2005346032 | 12/2005 |
| JP | 2006042191 | 2/2006 |
| JP | 2006317757 | 11/2006 |
| JP | 2007093990 | 4/2007 |
| JP | 2007212628 | 8/2007 |
| JP | 2007272023 | 10/2007 |
| JP | 2007299001 | 11/2007 |
| JP | 2009109876 | 5/2009 |
| WO | WO02099557 | 12/2002 |
| WO | WO2004075155 | 9/2004 |
| WO | WO2005029459 | 3/2005 |
| WO | WO03039137 | 5/2006 |

OTHER PUBLICATIONS

L. Kerofsky and S. Daly "Brightness preservation for LCD backlight reduction" SID Symposium Digest vol. 37, 1242-1245 (2006).

L. Kerofsky and S. Daly "Addressing Color in brightness preservation for LCD backlight reduction" ADEAC 2006 pp. 159-162.

L. Kerofsky "LCD Backlight Selection through Distortion Minimization", IDW 2007 pp. 315-318.

International Application No. PCT/JP08/053895 International Search Report.

U.S. Appl. No. 11/154,054—Office Action dated Aug. 5, 2008.

U.S. Appl. No. 11/460,940—Office Action dated Aug. 7, 2008.

U.S. Appl. No. 11/564,203—Non-final Office Action dated Sep. 24, 2009.

U.S. Appl. No. 11/154,052—Non-final Office Action dated Nov. 10, 2009.

U.S. Appl. No. 11/154,054—Final Office Action dated Jun. 24, 2009.

U.S. Appl. No. 11/154,053—Non-final Office Action dated Jul. 23, 2009.

U.S. Appl. No. 11/202,903—Non-final Office Action dated Aug. 7, 2009.

U.S. Appl. No. 11/202,903—Final Office Action dated Dec. 28, 2009.

U.S. Appl. No. 11/224,792—Non-final Office Action dated Nov. 18, 2009.

U.S. Appl. No. 11/371,466—Non-final Office Action dated Dec. 14, 2009.

U.S. Appl. No. 11/154,054—Non-final Office Action dated Jan. 7, 2009.

U.S. Appl. No. 11/293,562—Non-final Office Action dated Jan. 7, 2009.

U.S. Appl. No. 11/564,203—Notice of Allowance dated Apr. 2, 2010.

U.S. Appl. No. 11/154,052—Notice of Allowance dated May 21, 2010.

U.S. Appl. 11/154,053—Final Office Action dated Mar. 4, 2010.

U.S. Appl. No. 11/465,436—Notice of Allowance dated Apr. 20, 2010.

U.S. Appl. No. 11/680,539—Non-Final Office Action dated May 19, 2010.

U.S. Appl. No. 11/224,792—Final Office Action dated Jun. 11, 2010.

U.S. Appl. No. 11/154,054—Final Office Action dated Aug. 9, 2010.

U.S. Appl. 11/293,562—Final Office Action dated Jul. 8, 2010.

U.S. Appl. No. 11/371,466—Notice of Allowance dated Jul. 13, 2010.

(56) References Cited

OTHER PUBLICATIONS

U.S. Appl. No. 11/460,907—Non-Final Office Action dated Aug. 30, 2010.
U.S. Appl. No. 11/460,768—Non-Final Office Action dated Sep. 3, 2010.
U.S. Appl. No. 11/680,312—Non-Final Office Action dated Sep. 9, 2010.
U.S. Appl. No. 11/948,969—Non-Final Office Action dated Oct. 4, 2010.
International Application No. PCT/JP08/069815 International Search Report, 2008.
International Application No. PCT/JP08/072215 International Search Report, 2008.
International Application No. PCT/JP08/073898 International Search Report, 2008.
International Application No. PCT/JP08/073146 International Search Report, 2008.
International Application No. PCT/JP08/072715 International Search Report, 2008.
International Application No. PCT/JP08/073020 International Search Report, 2008.
International Application No. PCT/JP08/072001 International Search Report, 2008.
International Application No. PCT/JP04/013856 International Search Report, 2008.
PCT App. No. PCT/JP08/071909—Invitation to Pay Additional Fees dated Jan. 13, 2009.
U.S. Appl. No. 11/154,052—Office Action dated Apr. 27, 2009.
U.S. Appl. No. 11/154,053—Office Action dated Jan. 26, 2009.
U.S. Appl. No. 11/202,903—Office Action dated Feb. 5, 2009.
U.S. Appl. No. 11/224,792—Office Action dated Apr. 15, 2009.
U.S. Appl. No. 11/371,466—Office Action dated Apr. 14, 2009.
International Application No. PCT/JP08/071909 International Search Report, 2009.
PCT App. No. PCT/JP08/073020—Replacement Letter dated Apr. 21, 2009.
International Application No. PCT/JP08/064669 International Search Report, 2008.
Richard J. Qian, et al, "Image Retrieval Using Blob Histograms", Proceeding of 2000 IEEE International Conference on Multimedia and Expo, vol. 1, Aug. 2, 2000, pp. 125-128.
U.S. Appl. No. 11/154,054—Office Action dated Dec. 30, 2008.
U.S. Appl. No. 11/154,053—Office Action dated Oct. 1, 2008.
U.S. Appl. No. 11/460,940—Notice of Allowance dated Dec. 15, 2008.
U.S. Appl. No. 11/202,903—Office Action dated Oct. 3, 2008.
U.S. Appl. No. 11/224,792—Office Action dated Nov. 10, 2008.
U.S. Appl. No. 11/371,466—Office Action dated Sep. 23, 2008.
PCT App. No. PCT/JP2008/064669—Invitation to Pay Additional Fees dated Sep. 29, 2008.
PCT App. No. PCT/JP2008/069815—Invitation to Pay Additional Fees dated Dec. 5, 2005.
Rafal Mantiuk, Scott Daly, Louis Kerofsky, "Display Adaptive Tone Mapping", ACM Transactions on Graphics, Aug. 2008, vol. 27, No. 3, Article 68.
Pierre De Greef and Hendriek Groot Hulze NXP Semiconductors (Founded by Philips) et al: "39.1: Adaptive Dimming and Boosting Backlight for LCD-TV Systems", SID 2007, 2007 SID International Symposium, Society for Information Display, Los Angeles, USA, vol. XXXVIII, May 20, 2007, pp. 1332-1335, XP007013259, ISSN: 0007-966X.
International Application No. PCT/JP2010/064123 International Search Report, 2010.
International Application No. PCT/JP2008/072215 European Search Report, 2011.
International Application No. PCT/JP2008/0723020 European Search Report, 2011.
International Application No. PCT/JP2008/069815 European Search Report, 2011.
U.S. Appl. No. 11/293,562—Notice of Allowance dated Dec. 8, 2010.
U.S. Appl. No. 11/224,792—Notice of Allowance dated Feb. 9, 2011.
U.S. Appl. No. 11/964,683—Non-final Office Action dated Dec. 28, 2010.
U.S. Appl. No. 11/154,053—Non-final Office Action dated Mar. 1, 2011.
U.S. Appl. No. 11/202,903—Non-final Office Action dated Mar. 1, 2011.
U.S. Appl. No. 11/964,691—Non-final Office Action dated Mar. 3, 2011.
International Application No. PCT/US05/043560 International Search Report, 2007.
International Application No. PCT/US05/043560 International Preliminary Examination Report, 2007.
International Application No. PCT/US05/043641 International Search Report, 2006.
International Application No. PCT/US05/043641 International Preliminary Examination Report, 2007.
International Application No. PCT/US05/043647 International Search Report, 2007.
International Application No. PCT/US05/043647 International Preliminary Examination Report, 2007.
International Application No. PCT/US05/043640 International Search Report, 2007.
International Application No. PCT/US05/043640 International Preliminary Examination Report, 2007.
International Application No. PCT/US05/043646 International Search Report, 2007.
International Application No. PCT/US05/043646 International Preliminary Examination Report, 2007.
U.S. Appl. No. 11/154,054—Office Action dated Mar. 25, 2008.
U.S. Appl. No. 11/371,466—Office Action dated Oct. 5, 2007.
U.S. Appl. No. 11/371,466—Office Action dated Apr. 11, 2008.
Decision to Grant issued by the Japanese Patent Office on Apr. 3, 2012 in Japanese Patent App. No. 2006-105489, Sharp Kabushiki Kaisha, 2 pgs.
Wei-Chung Cheng and Massoud Pedram, "Power Minimization in a Backlit TFT-LCD Display by Concurrent Brightness and Contrast Scaling" IEEE Transactions on Consumer Electronics, Vo. 50, No. 1, Feb. 2004.
Insun Hwang, Cheol Woo Park, Sung Chul Kang and Dong Sik Sakong, "Image Synchronized Brightness Control" SID Symposium Digest 32, 492 (2001).
Inseok Choi, Hojun Shim and Naehyuck Chang, "Low-Power Color TFT LCD Display for Hand-Held Embedded Systems", in ISLPED, 2002.
A. Iranli, H. Fatemi, and M. Pedram, "HEBS: Histogram equalization for backlight scaling," Proc. of Design Automation and Test in Europe, Mar. 2005, pp. 346-351.
Chang, N., Choi, I., and Shim, H. 2004. DLS: dynamic backlight luminance scaling of liquid crystal display. IEEE Trans. Very Large Scale Integr. Syst. 12, 8 (Aug. 2004), 837-846.
S. Pasricha, M Luthra, S. Mohapatra, N. Dutt, N. Venkatasubramanian, "Dynamic Backlight Adaptation for Low Power Handheld Devices," to appear in IEEE Design and Test (IEEE D&T), Special Issue on Embedded Systems for Real Time Embedded Systems, Sep. 2004. 8.
H. Shim, N. Chang, and M. Pedram, "A backlight power management framework for the battery-operated multi-media systems." IEEE Design and Test Magazine, Sep./Oct. 2004, pp. 388-396.
F. Gatti, A. Acquaviva, L. Benini, B. Ricco', "Low-Power Control Techniques for TFT LCD Displays," Compiler, Architectures and Synthesis of Embedded Systems, Oct. 2002.
Ki-Duk Kim, Sung-Ho Baik, Min-Ho Sohn, Jae-Kyung Yoon, Eui-Yeol Oh and In-Jae Chung, "Adaptive Dynamic Image Control for IPS-Mode LCD TV", SID Symposium Digest 35, 1548 (2004).
Raman and Hekstra, "Content Based Contrast Enhancement for Liquid Crystal Displays with Backlight Modulation", IEEE Transactions on Consumer Electronics, vol. 51, No. 1, Feb. 2005.

(56) References Cited

OTHER PUBLICATIONS

E.Y. Oh, S. H. Balik, M. H. Sohn, K. D. Kim, H. J. Hong, J.Y. Bang, K.J. Kwon, M.H. Kim, H. Jang, J.K. Yoon and I.J. Chung, "IPS-mode dynamic LCD-TV realization with low black luminance and high contrast by adaptive dynamic image control technology", Journal of the Society for Information Display, Mar. 2005, vol. 13, Issue 3, pp. 181-266.

Fabritus, Grigore, Muang, Loukusa, Mikkonen, "Towards energy aware system design", Online via Nokia (http://www.nokia.com/nokia/0,,53712,00.html), 2003.

Choi, I., Kim, H.S., Shin, H. and Chang, N. "LPBP: Low-power basis profile of the Java 2 micro edition" in Proceedings of the 2003 International Symposium on Low Power Electronics and Design (Seoul, Korea, Aug. 2003) ISLPED '03. ACM Press, New York, NY, p. 36-39.

* cited by examiner

METHODS AND SYSTEMS FOR DISPLAY-MODE-DEPENDENT BRIGHTNESS PRESERVATION

RELATED REFERENCES

This application is a continuation-in-part of U.S. patent application Ser. No. 11/224,792, entitled "Methods and Systems for Image-Specific Tone Scale Adjustment and Light-Source Control," filed on Sep. 12, 2005 which claims the benefit of U.S. Provisional Patent Application No. 60/710,927, entitled "Image Dependent Backlight Modulation," filed on Aug. 23, 2005 and which is a continuation-in-part of U.S. patent application Ser. No. 11/154,053, entitled "Methods and Systems for Enhancing Display Characteristics with High Frequency Contrast Enhancement," filed on Jun. 15, 2005; and which is also a continuation-in-part of U.S. patent application Ser. No. 11/154,054, entitled "Methods and Systems for Enhancing Display Characteristics with Frequency-Specific Gain," filed on Jun. 15, 2005; and which is also a continuation-in-part of U.S. patent application Ser. No. 11/154,052, entitled "Methods and Systems for Enhancing Display Characteristics," filed on Jun. 15, 2005; which claims the benefit of U.S. Provisional Patent Application No. 60/670,749, entitled "Brightness Preservation with Contrast Enhancement," filed on Apr. 11, 2005; and claims the benefit of U.S. Provisional Patent Application No. 60/660,049, entitled "Contrast Preservation and Brightness Preservation in Low Power Mode of a Backlit Display," filed on Mar. 9, 2005; and claim the benefit of U.S. Provisional Patent Application No. 60/632,776, entitled "Luminance Matching for Power Saving Mode in Backlit Displays," filed on Dec. 2, 2004; and claims the benefit of U.S. Provisional Patent Application No. 60/632,779, entitled "Brightness Preservation for Power Saving Modes in Backlit Displays," filed on Dec. 2, 2004.

FIELD OF THE INVENTION

Embodiments of the present invention comprise methods and systems for adjusting code values of display content based on a display mode and methods and systems for adjusting a display light source in conjunction with display content code value adjustment.

BACKGROUND

A typical display device displays an image using a fixed range of luminance levels. For many displays, the luminance range has 256 levels that are uniformly spaced from 0 to 255. Image code values are generally assigned to match these levels directly.

In many electronic devices with large displays, the displays are the primary power consumers. For example, in a laptop computer, the display is likely to consume more power than any of the other components in the system. Many displays with limited power availability, such as those found in battery-powered devices, may use several illumination or brightness levels to help manage power consumption. A system may use a full-power mode when it is plugged into a power source, such as A/C power, and may use a power-save mode when operating on battery power.

In some devices, a display may automatically enter a power-save mode, in which the display illumination is reduced to conserve power. These devices may have multiple power-save modes in which illumination is reduced in a stepwise fashion. Generally, when the display illumination is reduced, image quality drops as well. When the maximum luminance level is reduced, the dynamic range of the display is reduced and image contrast suffers. Therefore, the contrast and other image qualities are reduced during typical power-save mode operation.

Many display devices, such as liquid crystal displays (LCDs) or digital micro-mirror devices (DMDs), use light valves which are backlit, side-lit or front-lit in one way or another. In a backlit light valve display, such as an LCD, a backlight is positioned behind a liquid crystal panel. The backlight radiates light through the LC panel, which modulates the light to register an image. Both luminance and color can be modulated in color displays. The individual LC pixels modulate the amount of light that is transmitted from the backlight and through the LC panel to the user's eyes or some other destination. In some cases, the destination may be a light sensor, such as a coupled-charge device (CCD).

Some displays may also use light emitters to register an image. These displays, such as light emitting diode (LED) displays and plasma displays use picture elements that emit light rather than reflect light from another source.

SUMMARY

Some embodiments of the present invention comprise systems and methods for display-mode-dependent adjustment of display content code values. Some embodiments may comprise a plurality of tone scale adjustment models that may be applied to display content dependent on the current mode of the display. Some embodiments may comprise a variable-level tone scale adjustment model that is applied to varying degrees or levels based on the current mode of the display. In some embodiments, a single tone scale adjustment model may be selectively applied to display content. In some embodiments a display light source may be modulated or adjusted in conjunction with tone scale adjustments.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EXEMPLARY EMBODIMENTS

Figure 1:
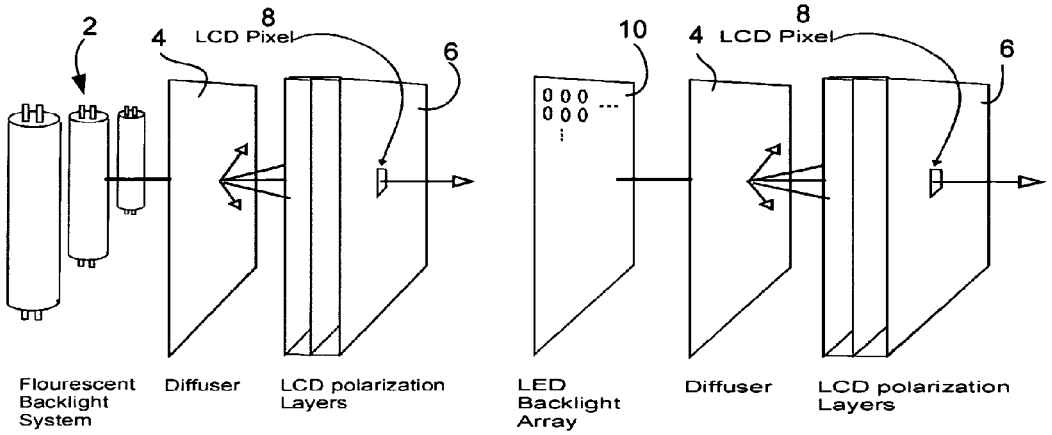
FIG. 1 is a diagram showing prior art backlit LCD systems.

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

Display devices using light valve modulators, such as LC modulators and other modulators may be reflective, wherein light is radiated onto the front surface (facing a viewer) and reflected back toward the viewer after passing through the modulation panel layer. Display devices may also be transmissive, wherein light is radiated onto the back of the modulation panel layer and allowed to pass through the modulation layer toward the viewer. Some display devices may also be transflexive, a combination of reflective and transmissive, wherein light may pass through the modulation layer from back to front while light from another source is reflected after entering from the front of the modulation layer. In any of these cases, the elements in the modulation layer, such as the individual LC elements, may control the perceived brightness of a pixel.

In backlit, front-lit and side-lit displays, the light source may be a series of fluorescent tubes, an LED array or some other source. Once the display is larger than a typical size of about 18", the majority of the power consumption for the device is due to the light source. For certain applications, and in certain markets, a reduction in power consumption is important. However, a reduction in power means a reduction in the light flux of the light source, and thus a reduction in the maximum brightness of the display.

A basic equation relating the current gamma-corrected light valve modulator's gray-level code values, CV, light source level, $L_{source}$, and output light level, $L_{out}$, is:

$$L_{out}=L_{source}*g(\mathrm{CV}+\mathrm{dark})^{\gamma}+\mathrm{ambient} \quad (1)$$

Where g is a calibration gain, dark is the light valve's dark level, and ambient is the light hitting the display from the room conditions. From this equation, it can be seen that reducing the backlight light source by x % also reduces the light output by x %.

The reduction in the light source level can be compensated by changing the light valve's modulation values; in particular, boosting them. In fact, any light level less than (1-x %) can be reproduced exactly while any light level above (1-x %) cannot be reproduced without an additional light source or an increase in source intensity.

Setting the light output from the original and reduced sources gives a basic code value correction that may be used to correct code values for an x % reduction (assuming dark and ambient are 0) is:

$$L_{out}=L_{source}*g(\mathrm{CV})^{\gamma}=L_{reduced}*g(\mathrm{CV}_{boost})^{\gamma} \quad (2)$$

$$\mathrm{CV}_{boost}=\mathrm{CV}*(L_{source}/L_{reduced})^{1/\gamma}=\mathrm{CV}*(1/x\,\%)^{1/\gamma} \quad (3)$$

Figure 2A:
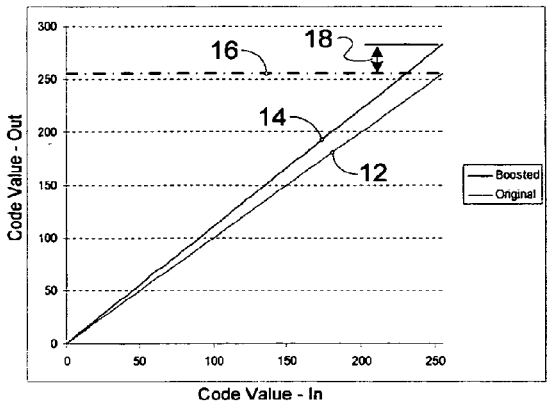
FIG. 2A is a chart showing the relationship between original image code values and boosted image code values.
Figure 2B:
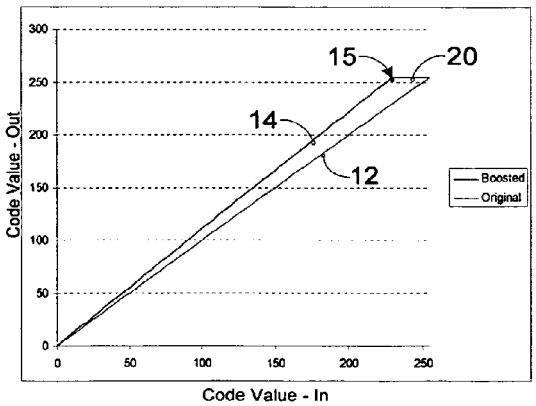
FIG. 2B is a chart showing the relationship between original image code values and boosted image code values with clipping.

FIG. 2A illustrates this adjustment. In FIGS. 2A and 2B, the original display values correspond to points along line 12. When the backlight or light source is placed in power-save mode and the light source illumination is reduced, the display code values need to be boosted to allow the light valves to counteract the reduction in light source illumination. These boosted values coincide with points along line 14. However, this adjustment results in code values 18 higher than the display is capable of producing (e.g., 255 for an 8 bit display). Consequently, these values end up being clipped 20 as illustrated in FIG. 2B. Images adjusted in this way may suffer from washed out highlights, an artificial look, and generally low quality.

Using this simple adjustment model, code values below the clipping point 15 (input code value 230 in this exemplary embodiment) will be displayed at a luminance level equal to the level produced with a full power light source while in a reduced source light illumination mode. The same luminance is produced with a lower power resulting in power savings. If the set of code values of an image are confined to the range below the clipping point 15 the power savings mode can be operated transparently to the user. Unfortunately, when values exceed the clipping point 15, luminance is reduced and detail is lost. Embodiments of the present invention provide an algorithm that can alter the LCD or light valve code values to provide increased brightness (or a lack of brightness reduction in power save mode) while reducing clipping artifacts that may occur at the high end of the luminance range.

Some embodiments of the present invention may eliminate the reduction in brightness associated with reducing display light source power by matching the image luminance displayed with low power to that displayed with full power for a significant range of values. In these embodiments, the reduction in source light or backlight power which divides the output luminance by a specific factor is compensated for by a boost in the image data by a reciprocal factor.

Ignoring dynamic range constraints, the images displayed under full power and reduced power may be identical because the division (for reduced light source illumination) and multiplication (for boosted code values) essentially cancel across a significant range. Dynamic range limits may cause clipping artifacts whenever the multiplication (for code value boost) of the image data exceeds the maximum of the display. Clipping artifacts caused by dynamic range constraints may be eliminated or reduced by rolling off the boost at the upper end of code values. This roll-off may start at a maximum fidelity point (MFP) above which the luminance is no longer matched to the original luminance.

In some embodiments of the present invention, the following steps may be executed to compensate for a light source illumination reduction or a virtual reduction for image enhancement:

1) A source light (backlight) reduction level is determined in terms of a percentage of luminance reduction;
2) A Maximum Fidelity Point (MFP) is determined at which a roll-off from matching reduced-power output to full-power output occurs;
3) Determine a compensating tone scale operator;
   a. Below the MFP, boost the tone scale to compensate for a reduction in display luminance;
   b. Above the MFP, roll off the tone scale gradually (in some embodiments, keeping continuous derivatives);
4) Apply tone scale mapping operator to image; and
5) Send to the display.

The primary advantage of these embodiments is that power savings can be achieved with only small changes to a narrow category of images. (Differences only occur above the MFP and consist of a reduction in peak brightness and some loss of bright detail). Image values below the MFP can be displayed in the power savings mode with the same luminance as the full power mode making these areas of an image indistinguishable from the full power mode.

Some embodiments of the present invention may use a tone scale map that is dependent upon the power reduction and display gamma and which is independent of image data. These embodiments may provide two advantages. Firstly, flicker artifacts which may arise due to processing frames differently do not arise, and, secondly, the algorithm has a very low implementation complexity. In some embodiments, an off-line tone scale design and on-line tone scale mapping may be used. Clipping in highlights may be controlled by the specification of the MFP.

Figure 3:
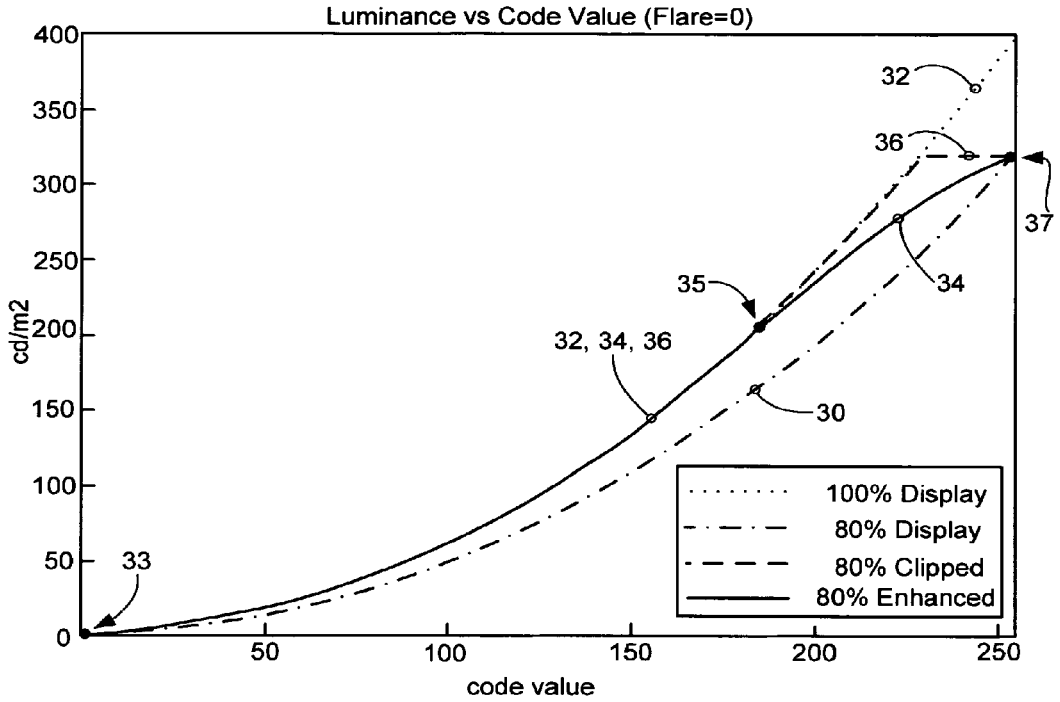
FIG. 3 is a chart showing the luminance level associated with code values for various code value modification schemes.

Some aspects of embodiments of the present invention may be described in relation to FIG. 3. FIG. 3 is a graph showing image code values plotted against luminance for several situations. A first curve 32, shown as dotted, represents the original code values for a light source operating at 100% power. A second curve 30, shown as a dash-dot curve, represents the luminance of the original code values when the light source operates at 80% of full power. A third curve 36, shown as a dashed curve, represents the luminance when code values are boosted to match the luminance provided at 100% light source illumination while the light source operates at 80% of full power. A fourth curve 34, shown as a solid line, represents the boosted data, but with a roll-off curve to reduce the effects of clipping at the high end of the data.

In this exemplary embodiment, shown in FIG. 3, an MFP 35 at code value 180 was used. Note that below code value 180, the boosted curve 34 matches the luminance output 32 by the original 100% power display. Above 180, the boosted curve smoothly transitions to the maximum output allowed on the 80% display. This smoothness reduces clipping and quantization artifacts. In some embodiments, the tone scale function may be defined piecewise to match smoothly at the transition point given by the MFP 35. Below the MFP 35, the boosted tone scale function may be used. Above the MFP 35, a curve is fit smoothly to the end point of boosted tone scale curve at the MFP and fit to the end point 37 at the maximum code value [255]. In some embodiments, the slope of the curve may be matched to the slope of the boosted tone scale curve/line at the MFP 35. This may be achieved by matching the slope of the line below the MFP to the slope of the curve above the MFP by equating the derivatives of the line and curve functions at the MFP and by matching the values of the line and curve functions at that point. Another constraint on the curve function may be that it be forced to pass through the maximum value point [255,255] 37. In some embodiments the slope of the curve may be set to 0 at the maximum value point 37. In some embodiments, an MFP value of 180 may correspond to a light source power reduction of 20%.

In some embodiments of the present invention, the tone scale curve may be defined by a linear relation with gain, g, below the Maximum Fidelity Point (MFP). The tone scale may be further defined above the MFP so that the curve and its first derivative are continuous at the MFP. This continuity implies the following form on the tone scale function:

$$y = \begin{cases} g \cdot x & x < MFP \\ C + B \cdot (x - MFP) + A \cdot (x - MFP)^2 & x \geq MFP \end{cases}$$

$$C = g \cdot MFP$$

$$B = g$$

$$A = \frac{\text{Max} - (C + B \cdot (\text{Max} - MFP)}{(\text{Max} - MFP)^2}$$

$$A = \frac{\text{Max} - g \cdot \text{Max}}{(\text{Max} - MFP)^2}$$

$$A = \frac{\text{Max} \cdot (1 - g)}{(\text{Max} - MFP)^2}$$

$$y = \begin{cases} g \cdot x & x < MFP \\ g \cdot x + \text{Max} \cdot (1 - g) \cdot \left(\frac{x - MFP}{\text{Max} - MFP}\right)^2 & x \geq MFP \end{cases}$$

The gain may be determined by display gamma and brightness reduction ratio as follows:

$$g = \left(\frac{FullPower}{ReducedPower}\right)^{\frac{1}{\gamma}}$$

In some embodiments, the MFP value may be tuned by hand balancing highlight detail preservation with absolute brightness preservation.

The MFP can be determined by imposing the constraint that the slope be zero at the maximum point. This implies:

$$\text{slope} = \begin{cases} g & x < MFP \\ g + 2 \cdot \text{Max} \cdot (1 - g) \cdot \frac{x - MFP}{(\text{Max} - MFP)^2} & x \geq MFP \end{cases}$$

$$\text{slope (Max)} = g + 2 \cdot \text{Max} \cdot (1 - g) \cdot \frac{\text{Max} - MFP}{(\text{Max} - MFP)^2}$$

$$\text{slope (Max)} = g + \frac{2 \cdot \text{Max} \cdot (1 - g)}{\text{Max} - MFP}$$

-continued $$\text{slope (Max)} = \frac{g \cdot (\text{Max} - MFP) + 2 \cdot \text{Max} \cdot (1 - g)}{\text{Max} - MFP}$$

$$\text{slope (Max)} = \frac{2 \cdot \text{Max} - g \cdot (\text{Max} + MFP)}{\text{Max} - MFP}$$

In some exemplary embodiments, the following equations may be used to calculate the code values for simple boosted data, boosted data with clipping and corrected data, respectively, according to an exemplary embodiment.

$$ToneScale_{boost}(cv) = (1/x)^{1/\gamma} \cdot cv$$

$$ToneScale_{clipped}(cv) = \begin{cases} (1/x)^{1/\gamma} \cdot cv & cv \le 255 \cdot (x)^{1/\gamma} \\ 255 & \text{otherwise} \end{cases}$$

$$ToneScale_{corrected}(cv) = \begin{cases} (1/x)^{1/\gamma} \cdot cv & cv \le MFP \\ A \cdot cv^2 + B \cdot cv + C & \text{otherwise} \end{cases}$$

The constants A, B, and C may be chosen to give a smooth fit at the MFP and so that the curve passes through the point [255,255]. Plots of these functions are shown in FIG. 4.

Figure 4:
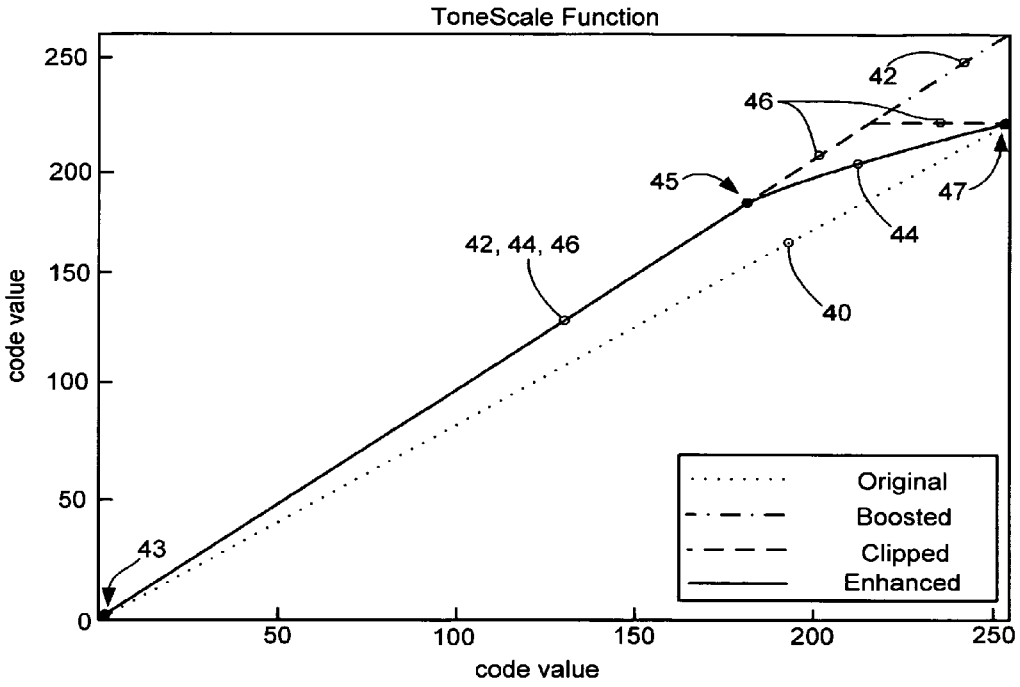
FIG. 4 is a chart showing the relationship between original image code values and modified image code values according to various modification schemes.

FIG. 4 is a plot of original code values vs. adjusted code values. Original code values are shown as points along original data line 40, which shows a 1:1 relationship between adjusted and original values as these values are original without adjustment. According to embodiments of the present invention, these values may be boosted or adjusted to represent higher luminance levels. A simple boost procedure according to the "tonescale boost" equation above, may result in values along boost line 42. Since display of these values will result in clipping, as shown graphically at line 46 and mathematically in the "tonescale clipped" equation above, the adjustment may taper off from a maximum fidelity point 45 along curve 44 to the maximum value point 47. In some embodiments, this relationship may be described mathematically in the "tonescale corrected" equation above.

Using these concepts, luminance values represented by the display with a light source operating at 100% power may be represented by the display with a light source operating at a lower power level. This is achieved through a boost of the tone scale, which essentially opens the light valves further to compensate for the loss of light source illumination. However, a simple application of this boosting across the entire code value range results in clipping artifacts at the high end of the range. To prevent or reduce these artifacts, the tone scale function may be rolled-off smoothly. This roll-off may be controlled by the MFP parameter. Large values of MFP give luminance matches over a wide interval but increase the visible quantization/clipping artifacts at the high end of code values.

Embodiments of the present invention may operate by adjusting code values. In a simple gamma display model, the scaling of code values gives a scaling of luminance values, with a different scale factor. To determine whether this relation holds under more realistic display models, we may consider the Gamma Offset Gain-Flair (GOG-F) model. Scaling the backlight power corresponds to linear reduced equations where a percentage, p, is applied to the output of the display, not the ambient. It has been observed that reducing the gain by a factor p is equivalent to leaving the gain unmodified and scaling the data, code values and offset, by a factor determined by the display gamma. Mathematically, the multiplicative factor can be pulled into the power function if suitably modified. This modified factor may scale both the code values and the offset.

Equation 1 GOG-F model $$L = G \cdot (\text{CV}+\text{dark})^{\gamma} + \text{ambient}$$

Equation 2 Linear Luminance Reduction $$L_{Linear\ reduced} = p \cdot G \cdot (\text{CV}+\text{dark})^{\gamma} + \text{ambient}$$

$$L_{Linear\ reduced} = G \cdot (p^{1/\gamma} \cdot (\text{CV}+\text{dark}))^{\gamma} + \text{ambient}$$

$$L_{Linear\ reduced} = G \cdot (p^{1/\gamma} \cdot \text{CV} + p^{1/\gamma} \cdot \text{dark})^{\gamma} + \text{ambient}$$

Equation 3 Code Value Reduction $$L_{CV\ reduced} = G \cdot (p^{1/\gamma} \cdot \text{CV}+\text{dark})^{\gamma} + \text{ambient}$$

Figure 5:
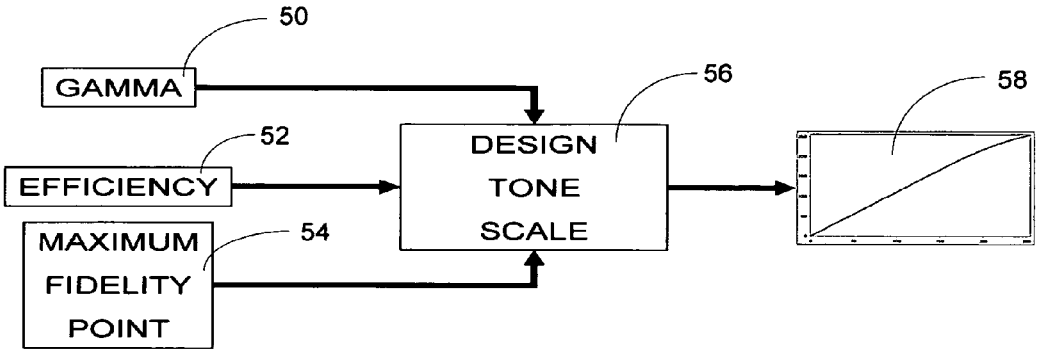
FIG. 5 is a diagram showing the generation of an exemplary tone scale adjustment model.

Some embodiments of the present invention may be described with reference to FIG. 5. In these embodiments, a tone scale adjustment may be designed or calculated off-line, prior to image processing, or the adjustment may be designed or calculated on-line as the image is being processed. Regardless of the timing of the operation, the tone scale adjustment 56 may be designed or calculated based on at least one of a display gamma 50, an efficiency factor 52 and a maximum fidelity point (MFP) 54. These factors may be processed in the tone scale design process 56 to produce a tone scale adjustment model 58. The tone scale adjustment model may take the form of an algorithm, a look-up table (LUT) or some other model that may be applied to image data.

Figure 6:
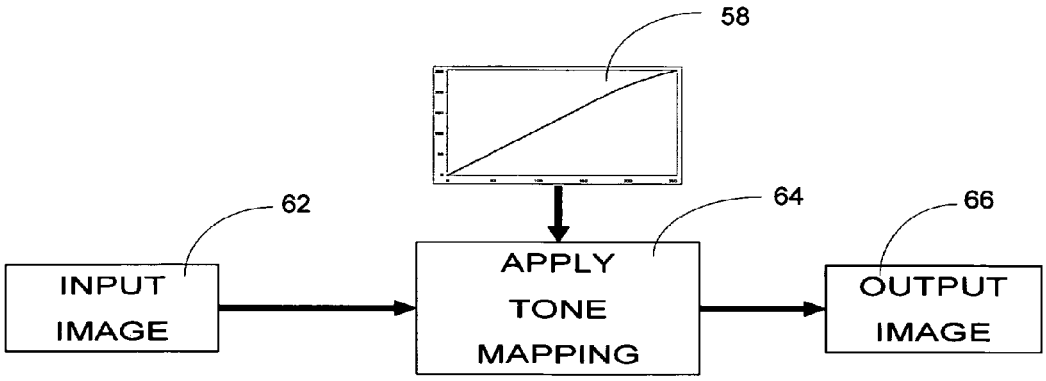
FIG. 6 is a diagram showing an exemplary application of a tone scale adjustment model.

Once the adjustment model 58 has been created, it may be applied to the image data. The application of the adjustment model may be described with reference to FIG. 6. In these embodiments, an image is input 62 and the tone scale adjustment model 58 is applied 64 to the image to adjust the image code values. This process results in an output image 66 that may be sent to a display. Application 64 of the tone scale adjustment is typically an on-line process, but may be performed in advance of image display when conditions allow.

Some embodiments of the present invention comprise systems and methods for enhancing images displayed on displays using light-emitting pixel modulators, such as LED displays, plasma displays and other types of displays. These same systems and methods may be used to enhance images displayed on displays using light-valve pixel modulators with light sources operating in full power mode or otherwise.

These embodiments work similarly to the previously-described embodiments, however, rather than compensating for a reduced light source illumination, these embodiments simply increase the luminance of a range of pixels as if the light source had been reduced. In this manner, the overall brightness of the image is improved.

In these embodiments, the original code values are boosted across a significant range of values. This code value adjustment may be carried out as explained above for other embodiments, except that no actual light source illumination reduction occurs. Therefore, the image brightness is increased significantly over a wide range of code values.

Some of these embodiments may be explained with reference to FIG. 3 as well. In these embodiments, code values for an original image are shown as points along curve 30. These values may be boosted or adjusted to values with a higher luminance level. These boosted values may be represented as points along curve 34, which extends from the zero point 33 to the maximum fidelity point 35 and then tapers off to the maximum value point 37.

Some embodiments of the present invention comprise an unsharp masking process. In some of these embodiments the unsharp masking may use a spatially varying gain. This gain may be determined by the image value and the slope of the modified tone scale curve. In some embodiments, the use of a gain array enables matching the image contrast even when the image brightness cannot be duplicated due to limitations on the display power.

Some embodiments of the present invention may take the following process steps:

1. Compute a tone scale adjustment model;
2. Compute a High Pass image;
3. Compute a Gain array;
4. Weight High Pass Image by Gain;
5. Sum Low Pass Image and Weighted High Pass Image; and
6. Send to the display Other embodiments of the present invention may take the following process steps:

1. Compute a tone scale adjustment model;
2. Compute Low Pass image;
3. Compute High Pass image as difference between Image and Low Pass image;
4. Compute Gain array using image value and slope of modified Tone Scale Curve;
5. Weight High Pass Image by Gain;
6. Sum Low Pass Image and Weighted High Pass Image; and
7. Send to the reduced power display.

Using some embodiments of the present invention, power savings can be achieved with only small changes on a narrow category of images. (Differences only occur above the MFP and consist of a reduction in peak brightness and some loss of bright detail). Image values below the MFP can be displayed in the power savings mode with the same luminance as the full power mode making these areas of an image indistinguishable from the full power mode. Other embodiments of the present invention improve this performance by reducing the loss of bright detail.

These embodiments may comprise spatially varying unsharp masking to preserve bright detail. As with other embodiments, both an on-line and an off-line component may be used. In some embodiments, an off-line component may be extended by computing a gain map in addition to the Tone Scale function. The gain map may specify an unsharp filter gain to apply based on an image value. A gain map value may be determined using the slope of the Tone Scale function. In some embodiments, the gain map value at a particular point "P" may be calculated as the ratio of the slope of the Tone Scale function below the MFP to the slope of the Tone Scale function at point "P." In some embodiments, the Tone Scale function is linear below the MFP, therefore, the gain is unity below the MFP.

Figure 7:
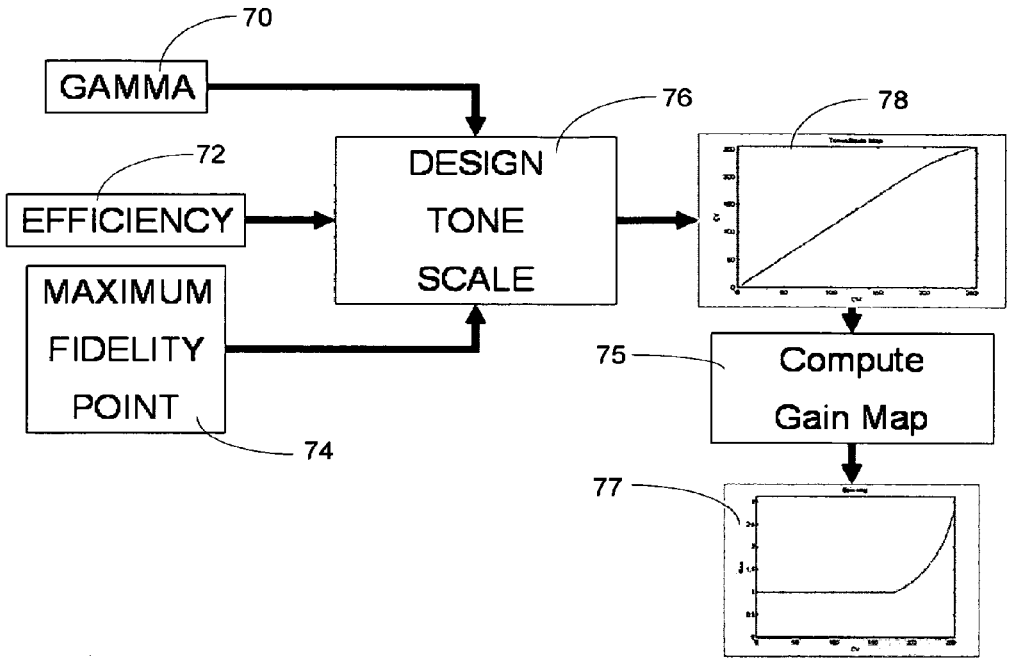
FIG. 7 is a diagram showing the generation of an exemplary tone scale adjustment model and gain map.

Some embodiments of the present invention may be described with reference to FIG. 7. In these embodiments, a tone scale adjustment may be designed or calculated off-line, prior to image processing, or the adjustment may be designed or calculated on-line as the image is being processed. Regardless of the timing of the operation, the tone scale adjustment 76 may be designed or calculated based on at least one of a display gamma 70, an efficiency factor 72 and a maximum fidelity point (MFP) 74. These factors may be processed in the tone scale design process 76 to produce a tone scale adjustment model 78. The tone scale adjustment model may take the form of an algorithm, a look-up table (LUT) or some other model that may be applied to image data as described in relation to other embodiments above. In these embodiments, a separate gain map 77 is also computed 75. This gain map 77 may be applied to specific image subdivisions, such as frequency ranges. In some embodiments, the gain map may be applied to frequency-divided portions of an image. In some embodiments, the gain map may be applied to a high-pass image subdivision. It may also be applied to specific image frequency ranges or other image subdivisions.

Figure 8:
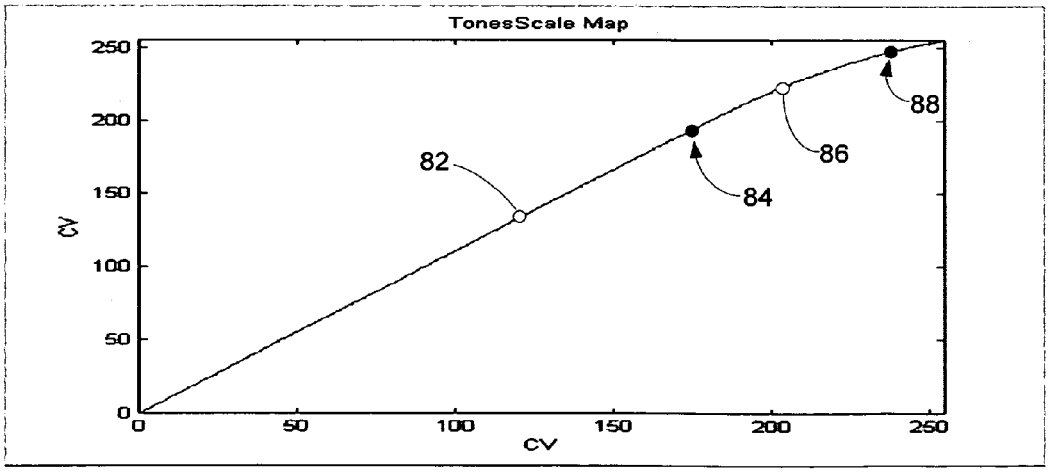
FIG. 8 is a chart showing an exemplary tone scale adjustment model.

An exemplary tone scale adjustment model may be described in relation to FIG. 8. In these exemplary embodiments, a Function Transition Point (FTP) 84 (similar to the MFP used in light source reduction compensation embodiments) is selected and a gain function is selected to provide a first gain relationship 82 for values below the FTP 84. In some embodiments, the first gain relationship may be a linear relationship, but other relationships and functions may be used to convert code values to enhanced code values. Above the FTP 84, a second gain relationship 86 may be used. This second gain relationship 86 may be a function that joins the FTP 84 with a maximum value point 88. In some embodiments, the second gain relationship 86 may match the value and slope of the first gain relationship 82 at the FTP 84 and pass through the maximum value point 88. Other relationships, as described above in relation to other embodiments, and still other relationships may also serve as a second gain relationship 86.

In some embodiments, a gain map 77 may be calculated in relation to the tone scale adjustment model, as shown in FIG. 8. An exemplary gain map 77, may be described in relation to FIG. 9. In these embodiments, a gain map function relates to the tone scale adjustment model 78 as a function of the slope of the tone scale adjustment model. In some embodiments, the value of the gain map function at a specific code value is determined by the ratio of the slope of the tone scale adjustment model at any code value below the FTP to the slope of the tone scale adjustment model at that specific code value. In some embodiments, this relationship may be expressed mathematically in the following equation:

$$\text{Gain}(cv) = \frac{ToneScaleSlope(1)}{ToneScaleSlope(cv)}$$

In these embodiments, the gain map function is equal to one below the FTP where the tone scale adjustment model results in a linear boost. For code values above the FTP, the gain map function increases quickly as the slope of the tone scale adjustment model tapers off. This sharp increase in the gain map function enhances the contrast of the image portions to which it is applied.

Figure 9:
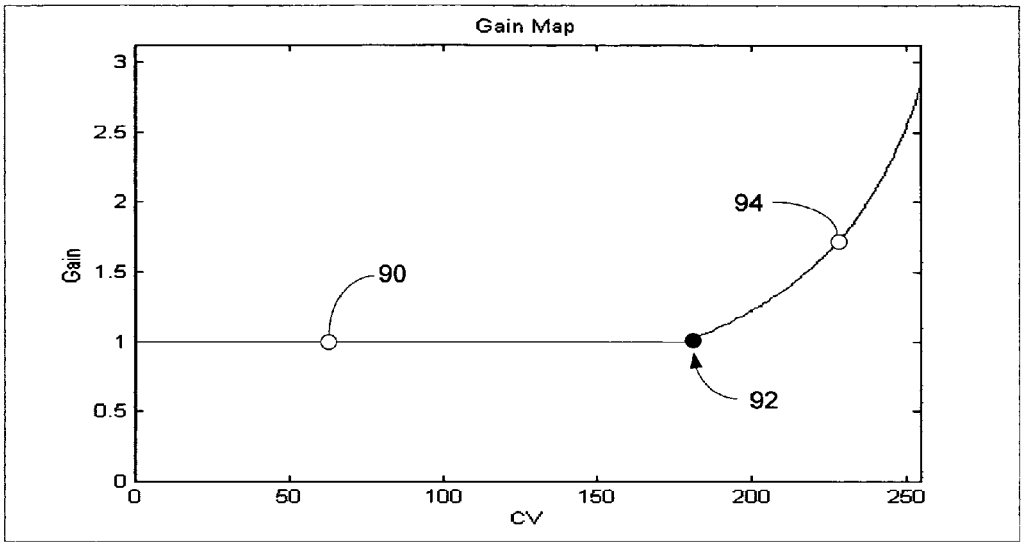
FIG. 9 is a chart showing an exemplary gain map.

The exemplary tone scale adjustment factor illustrated in FIG. 8 and the exemplary gain map function illustrated in FIG. 9 were calculated using a display percentage (source light reduction) of 80%, a display gamma of 2.2 and a Maximum Fidelity Point of 180.

In some embodiments of the present invention, an unsharp masking operation may be applied following the application of the tone scale adjustment model. In these embodiments, artifacts are reduced with the unsharp masking technique.

Figure 10:
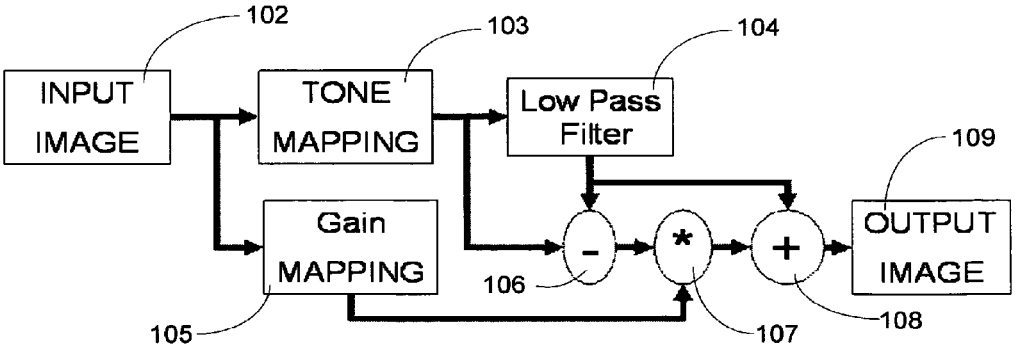
FIG. 10 is a flow chart showing an exemplary process wherein a tone scale adjustment model and gain map are applied to an image.

Some embodiments of the present invention may be described in relation to FIG. 10. In these embodiments, an original image 102 is input and a tone scale adjustment model 103 is applied to the image. The original image 102 is also used as input to a gain mapping process 105 which results in a gain map. The tone scale adjusted image is then processed through a low pass filter 104 resulting in a low-pass adjusted image. The low pass adjusted image is then subtracted 106 from the tone scale adjusted image to yield a high-pass adjusted image. This high-pass adjusted image is then multiplied 107 by the appropriate value in the gain map to provide a gain-adjusted high-pass image which is then added 108 to the low-pass adjusted image, which has already been adjusted with the tone scale adjustment model. This addition results in an output image 109 with increased brightness and improved high-frequency contrast.

In some of these embodiments, for each component of each pixel of the image, a gain value is determined from the Gain map and the image value at that pixel. The original image 102, prior to application of the tone scale adjustment model, may be used to determine the Gain. Each component of each pixel of the high-pass image may also be scaled by the corresponding gain value before being added back to the low pass image. At points where the gain map function is one, the unsharp masking operation does not modify the image values. At points where the gain map function exceeds one, the contrast is increased.

Some embodiments of the present invention address the loss of contrast in high-end code values, when increasing code value brightness, by decomposing an image into multiple frequency bands. In some embodiments, a Tone Scale Function may be applied to a low-pass band increasing the brightness of the image data to compensate for source-light luminance reduction on a low power setting or simply to increase the brightness of a displayed image. In parallel, a constant gain may be applied to a high-pass band preserving the image contrast even in areas where the mean absolute brightness is reduced due to the lower display power. The operation of an exemplary algorithm is given by:

1. Perform frequency decomposition of original image
2. Apply brightness preservation, Tone Scale Map, to a Low Pass Image
3. Apply constant multiplier to High Pass Image
4. Sum Low Pass and High Pass Images
5. Send result to the display The Tone Scale Function and the constant gain may be determined off-line by creating a photometric match between the full power display of the original image and the low power display of the process image for source-light illumination reduction applications. The Tone Scale Function may also be determined off-line for brightness enhancement applications.

For modest MFP values, these constant-high-pass gain embodiments and the unsharp masking embodiments are nearly indistinguishable in their performance. These constant-high-pass gain embodiments have three main advantages compared to the unsharp masking embodiments: reduced noise sensitivity, ability to use larger MFP/FTP and use of processing steps currently in the display system. The unsharp masking embodiments use a gain which is the inverse of the slope of the Tone Scale Curve. When the slope of this curve is small, this gain incurs a large amplifying noise. This noise amplification may also place a practical limit on the size of the MFP/FTP. The second advantage is the ability to extend to arbitrary MFP/FTP values. The third advantage comes from examining the placement of the algorithm within a system. Both the constant-high-pass gain embodiments and the unsharp masking embodiments use frequency decomposition. The constant-high-pass gain embodiments perform this operation first while some unsharp masking embodiments first apply a Tone Scale Function before the frequency decomposition. Some system processing such as de-contouring will perform frequency decomposition prior to the brightness preservation algorithm. In these cases, that frequency decomposition can be used by some constant-high-pass embodiments thereby eliminating a conversion step while some unsharp masking embodiments must invert the frequency decomposition, apply the Tone Scale Function and perform additional frequency decomposition.

Some embodiments of the present invention prevent the loss of contrast in high-end code values by splitting the image based on spatial frequency prior to application of the tone scale function. In these embodiments, the tone scale function with roll-off may be applied to the low pass (LP) component of the image. In light-source illumination reduction compensation applications, this will provide an overall luminance match of the low pass image components. In these embodiments, the high pass (HP) component is uniformly boosted (constant gain). The frequency-decomposed signals may be recombined and clipped as needed. Detail is preserved since the high pass component is not passed through the roll-off of the tone scale function. The smooth roll-off of the low pass tone scale function preserves head room for adding the boosted high pass contrast. Clipping that may occur in this final combination has not been found to reduce detail significantly.

Figure 11:
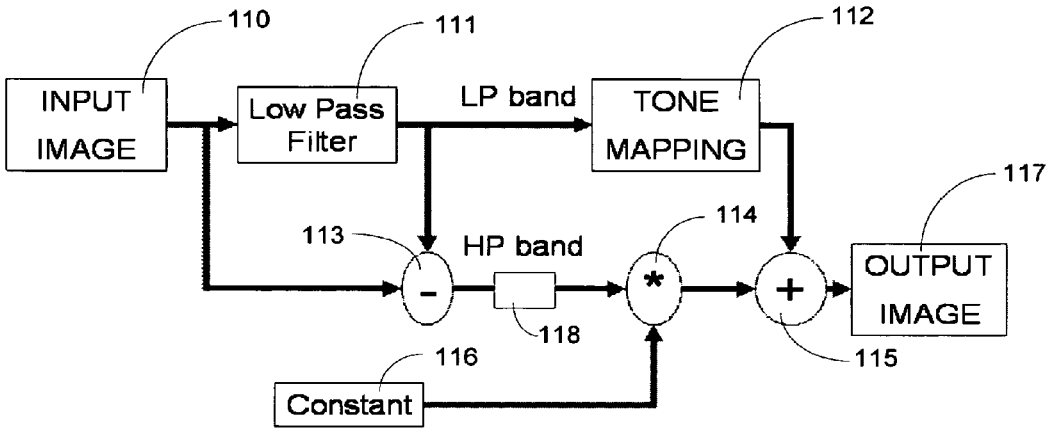
FIG. 11 is a flow chart showing an exemplary process wherein a tone scale adjustment model is applied to one frequency band of an image and a gain map is applied to another frequency band of the image.

Some embodiments of the present invention may be described with reference to FIG. 11. These embodiments comprise frequency splitting or decomposition 111, low-pass tone scale mapping 112, constant high-pass gain or boost 116 and summation or re-combination 115 of the enhanced image components.

In these embodiments, an input image 110 is decomposed into spatial frequency bands 111. In an exemplary embodiment, in which two bands are used, this may be performed using a low-pass (LP) filter 111. The frequency division is performed by computing the LP signal via a filter 111 and subtracting 113 the LP signal from the original to form a high-pass (HP) signal 118. In an exemplary embodiment, spatial 5×5 rect filter may be used for this decomposition though another filter may be used.

The LP signal may then be processed by application of tone scale mapping as discussed for previously described embodiments. In an exemplary embodiment, this may be achieved with a Photometric matching LUT. In these embodiments, a higher value of MFP/FTP can be used compared to some previously described unsharp masking embodiment since most detail has already been extracted in filtering 111. Clipping should not generally be used since some head room should typically be preserved in which to add contrast.

Figure 12:
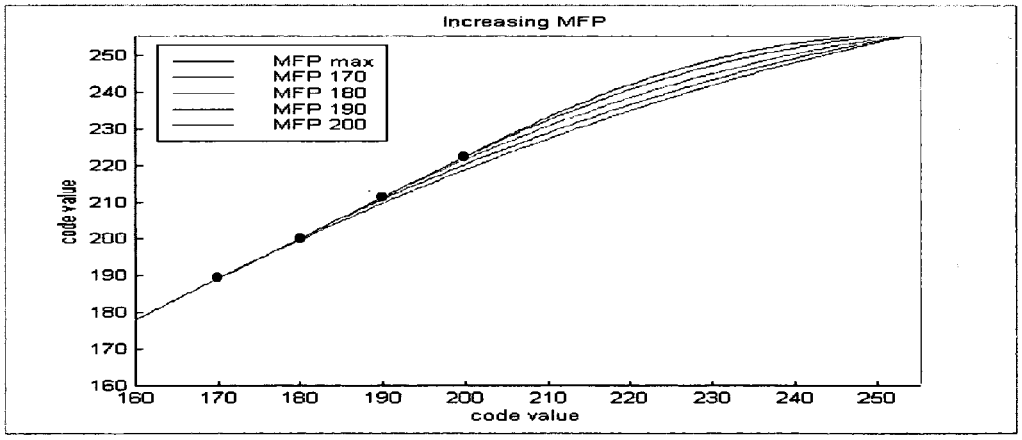
FIG. 12 is a chart showing tone scale adjustment model variations as the MFP changes.

In some embodiments, the MFP/FTP may be determined automatically and may be set so that the slope of the Tone Scale Curve is zero at the upper limit. A series of tone scale functions determined in this manner are illustrated in FIG. 12. In these embodiments, the maximum value of MFP/FTP may be determined such that the tone scale function has slope zero at 255. This is the largest MFP/FTP value that does not cause clipping.

In some embodiments of the present invention, described with reference to FIG. 11, processing the HP signal 118 is independent of the choice of MFP/FTP used in processing the low pass signal. The HP signal 118 is processed with a constant gain 116 which will preserve the contrast when the power/light-source illumination is reduced or when the image code values are otherwise boosted to improve brightness. The formula for the HP signal gain 116 in terms of the full and reduced backlight powers (BL) and display gamma is given immediately below as a high pass gain equation. The HP contrast boost is robust against noise since the gain is typically small (e.g. gain is 1.1 for 80% power reduction and gamma 2.2).

$$HighPassGain = \left(\frac{BL_{Full}}{BL_{Reduced}}\right)^{1/\gamma}$$

In some embodiments, once the tone scale mapping 112 has been applied to the LP signal, through LUT processing or otherwise, and the constant gain 116 has been applied to the HP signal, these frequency components may be summed 115 and, in some cases, clipped. Clipping may be necessary when the boosted HP value added to the LP value exceeds 255. This will typically only be relevant for bright signals with high contrast. In some embodiments, the LP signal is guaranteed not to exceed the upper limit by the tone scale LUT construction. The HP signal may cause clipping in the sum, but the negative values of the HP signal will never clip maintaining some contrast even when clipping does occur.

Display Mode Embodiments

Some embodiments of the present inventions comprise light source modulation and image code value adjustment that is dependent on a display or device mode. Display or device modes relate to the type of content being displayed or the function being performed by the display unit. In some embodiments a display may have a video mode, a TV mode, a text mode, a menu mode, a still image mode, a graphics mode or other display modes. A display mode may be designated by a user through a menu or other selection or may be designated automatically by a device, such as when a specific application is selected or activated. A display mode may be automatically invoked by an application or automatically invoked upon insertion of specific media, such as a memory card, into a device. In some embodiments, a display mode may be defined by the type of application that is in control of the display.

Some display modes have been found to have a high power consumption. Some display modes may require or benefit from image enhancement. Some display modes may benefit from adjusted code values to increase brightness and contrast. For example, a video mode may benefit from increased contrast over a range of image values, but high backlight levels will consume unacceptable amounts of power over the length of time of a video clip or message. As another example, a text mode or menu mode that is predominantly text-oriented will not benefit much from image code value manipulation as the contrast is generally sufficient even at reduced backlight levels.

Some embodiments of the present invention may manipulate code values to increase brightness and other image qualities only when specific display modes are employed. In some embodiments, image code values may be adjusted when a video mode is active, but left in an unadjusted state when a text mode is active.

In some embodiments, the level of image code value adjustment may be related to the display mode. For example, a high level of enhancement may be employed for a video or TV mode, a lesser degree of enhancement for a still image mode or graphics mode and little or no enhancement for a text or menu mode.

In some embodiments of the present invention, the method of code value adjustment may be dependent on the display mode active on the device. In some of these embodiments, a first image enhancement method may be employed when in a first display mode and a second image enhancement method may be employed when in a second display mode. For example, in a video display mode, an enhancement method that employs a linear gain function for a first set of code values and a rolloff curve function for a second set of code values may be used while another enhancement method that employs a tone scale adjustment curve for a first set of code values and a gain function for a second set of code values may be used for a text display mode.

Figure 13:
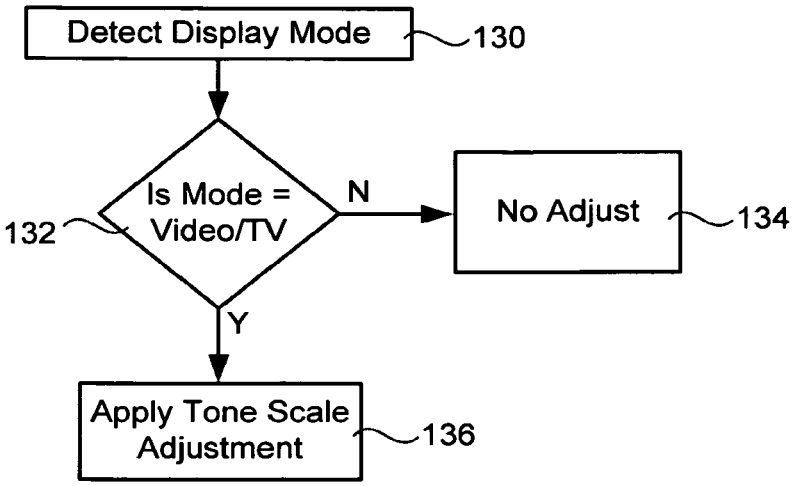
FIG. 13 is a chart showing selective application of a tone scale adjustment model based on display mode.

Some embodiments of the present invention may be described with reference to FIG. 13. In these embodiments a display mode is detected 130. This may be done by determining what application has control of the display, by sensing what display input is active, by determining what device function is a active or my other methods. Once a mode is detected, that mode may be compared 132 to a set of modes that require adjustment, if no match exists, no adjustment is performed 134. If a match exists, a tone scale adjustment is performed 136.

Figure 14:
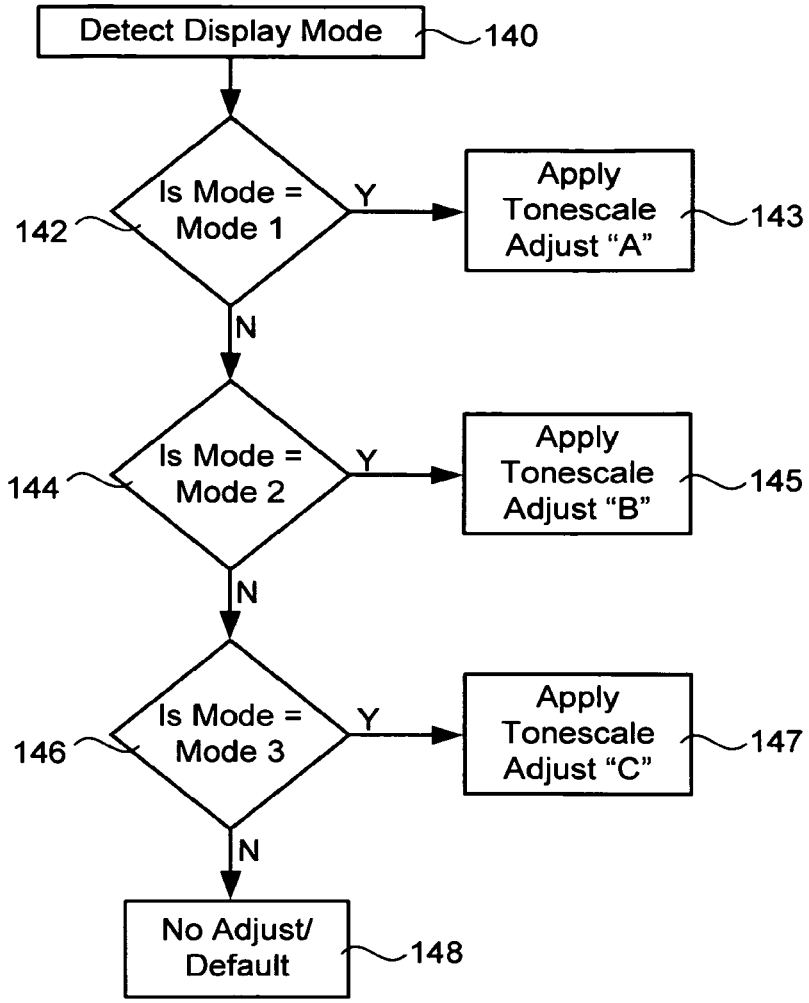
FIG. 14 is a chart showing a plurality of tone scale adjustment models selectively applied based on display mode.

Some embodiments of the present invention may be described with reference to FIG. 14. In these embodiments, a display mode is detected 140 as described above or by similar methods. The mode is then compared 142 with a known mode or set of modes. If the current mode matches a mode assigned to tone scale adjustment "A," e.g. Mode 1, tone scale adjustment "A" may be applied 143 to the display content. If not match occurs, another mode comparison 144 may be made. If the current mode matches a mode assigned to tone scale adjustment "B," e.g. Mode 2, tone scale adjustment "B" may be applied 145 to the display content.

If no match occurs in a prior comparison, another comparison 146 may be made. If the current mode matches a mode assigned to tone scale adjustment "C," e.g. Mode 3, tone scale adjustment "C" may be applied 147 to the display content. When the current mode does not match a mode assigned to a tone scale adjustment, no adjustment or a default adjustment may be applied 148 to the display content.

Figure 15:
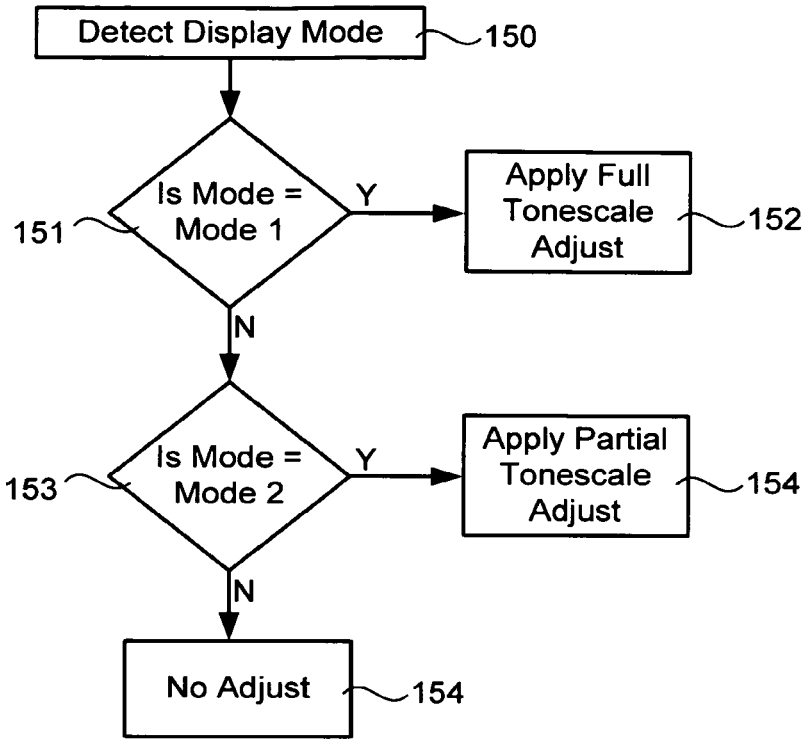
FIG. 15 is a chart showing variable application of a tone scale adjustment model based on display mode.

Some embodiments of the present invention may be described with reference to FIG. 15. In these embodiments, a display mode is detected 150 as described above or by similar methods. The mode is then compared 151 with a known mode or set of modes. If the current mode matches a mode in a set assigned to a full tone scale adjustment, a full tone scale adjustment may be applied 152 to the display content. If no match occurs for a full adjustment, a further comparison 153 may be performed. If the current mode matches a mode assigned to a partial tone scale adjustment, a partial tone scale adjustment may be applied 154 to the display content. If not match occurs between the current mode and an assigned mode, a default adjustment or no adjustment may be performed 155.

Figure 16A:
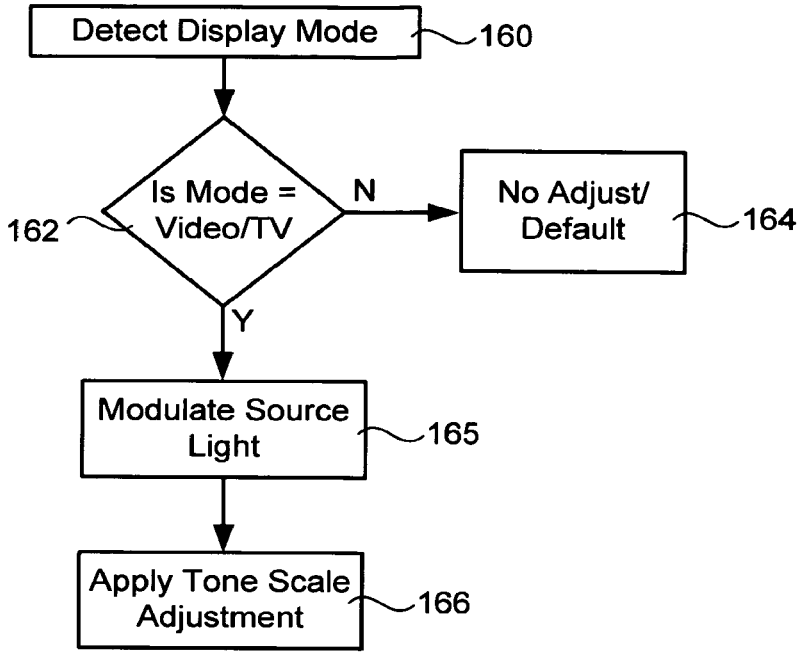
FIG. 16A is a chart showing selective application of a tone scale adjustment model and a light source adjustment based on display mode.

Some embodiments of the present invention may be described with reference to FIG. 16A. In these embodiments a display mode is detected 160. This may be done by determining what application has control of the display, by sensing what display input is active, by determining what device function is a active or my other methods. Once a mode is detected, that mode may be compared 162 to a set of modes that require adjustment, if no match exists, no adjustment may be performed or a default adjustment may be performed 164. If a match exists, the source light of the display may be adjusted 165 to a level prescribed for the specific mode detected. A tone scale adjustment may also be performed 136.

Figure 16B:
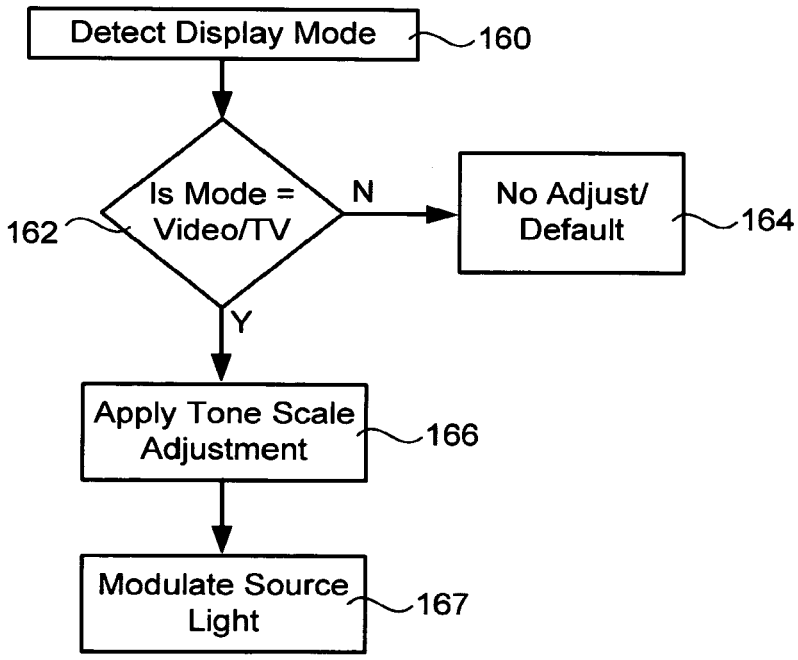
FIG. 16B is a chart showing selective application of a tone scale adjustment model and an alternative light source adjustment based on display mode.

Some embodiments of the present invention may be described with reference to FIG. 16B. In these embodiments a display mode is detected 160. This may be done by determining what application has control of the display, by sensing what display input is active, by determining what device function is a active or my other methods. Once a mode is detected, that mode may be compared 162 to a set of modes that require adjustment, if no match exists, no adjustment may be performed or a default adjustment may be performed 164. If a match exists, a tone scale adjustment may be performed 136 and a source light of the display may be adjusted 167 to a level prescribed for the specific mode detected.

Figure 17:
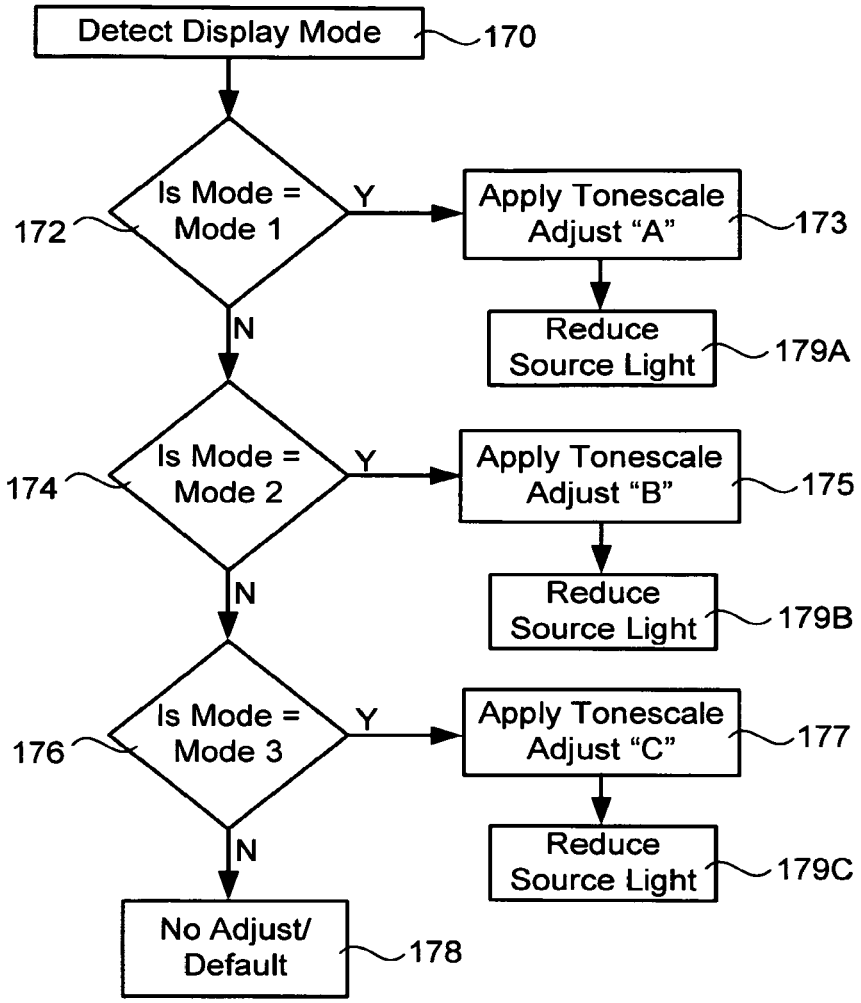
FIG. 17 is a chart showing a plurality of tone scale adjustment models selectively applied with light source adjustments based on display mode.

Some embodiments of the present invention may be described with reference to FIG. 17. In these embodiments, a display mode is detected 170 as described above or by similar methods. The mode is then compared 172 with a known mode or set of modes. If the current mode matches a mode assigned to tone scale adjustment "A," e.g. Mode 1, tone scale adjustment "A" may be applied 173 to the display content and the source light of the display may be modulated 179A to match the tone scale adjustment, "A." If not match occurs, another mode comparison 174 may be made. If the current mode matches a mode assigned to tone scale adjustment "B," e.g. Mode 2, tone scale adjustment "B" may be applied 145 to the display content and the source light of the display may be modulated 179B to match tone scale adjustment "B."

If no match occurs in a prior comparison, another comparison 176 may be made. If the current mode matches a mode assigned to tone scale adjustment "C," e.g. Mode 3, tone scale adjustment "C" may be applied 177 to the display content and the light source of the display may be modulated 179C to match tone scale adjustment "C.". When the current mode does not match a mode assigned to a tone scale adjustment, no adjustment or a default adjustment may be applied 178 to the display content.

Figure 18:
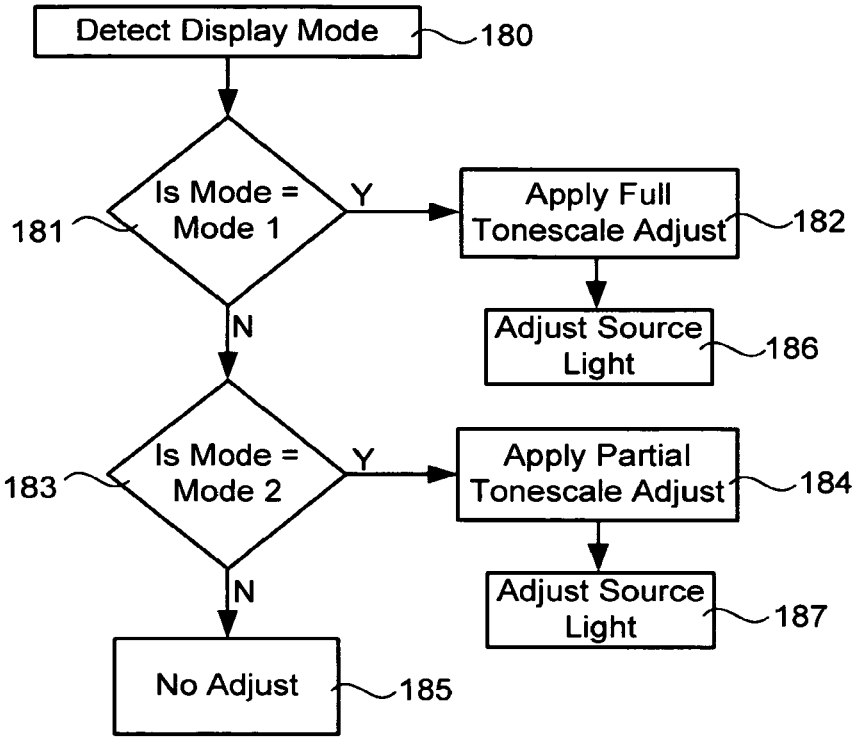
FIG. 18 is a chart showing variable application of a tone scale adjustment model with light source adjustments based on display mode.

Some embodiments of the present invention may be described with reference to FIG. 18. In these embodiments, a display mode is detected 180 as described above or by similar methods. The mode is then compared 181 with a known mode or set of modes. If the current mode matches a mode in a set assigned to a full tone scale adjustment, a full tone scale adjustment may be applied 182 to the display content and the source light may be adjusted accordingly 186. If no match occurs for a full adjustment, a further comparison 183 may be performed. If the current mode matches a mode assigned to a partial tone scale adjustment, a partial tone scale adjustment may be applied 184 to the display content and the source light may be adjusted accordingly 187. If no match occurs between the current mode and an assigned mode, a default adjustment or no adjustment may be performed 185.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

What is claimed is:

1. A method for display mode-dependent adjustment of image code values, said method comprising:

detecting a display mode for a display, wherein said display comprises a display source light and a plurality of light valves modulated to form a display image based on image code values of an input image and wherein said display mode relates to a source light illumination level for said display source light;

adjusting said source light to said source light illumination level corresponding to said display mode when said display mode meets a criterion; and adjusting code values in an input image to be displayed on said display using said display mode and said source light illumination level such that said adjusting code values compensates for said adjusting said source light to said source light illumination level when said display mode meets said criterion.

2. The method as described in claim 1 wherein said adjusting code values comprises applying a tone scale adjustment model.

3. The method as described in claim 2 wherein said adjusting code values is proportional to the ratio of the slope of the tone scale adjustment model at a point below an MFP and the slope of the tone scale adjustment model at a specific code value.

4. The method as described in claim 1 wherein said adjusting code values comprises applying a gain map function to said code values.

5. The method as described in claim 4 wherein said gain map function is dependent on at least one of a display gamma, an efficiency factor and a maximum fidelity point (MFP).

6. The method as described in claim 1 wherein said adjusting code values comprises applying a constant gain multiplier to a first range of code values and applying a roll-off curve to a second range of code values.

7. The method as described in claim 6 wherein said roll-off curve begins at a value of said constant gain multiplier at an MFP and ends at a point that maps a maximum code value to a maximum display level.

8. The method as described in claim 6 wherein said roll-off curve matches the slope of said constant gain multiplier at an MFP point.

9. The method as described in claim 6 wherein said roll-off curve has a slope of zero at an end point.

10. The method as described in claim 1 wherein said adjusting code values comprises applying a gain adjustment to a range of code values below a maximum fidelity point (MFP) and applying a roll-off curve map to code values above said MFP point.

11. The method as described in claim 1 wherein said adjusting code values comprises adjusting the code values of a first group of image pixels to increase the perceived brightness of said pixels by applying a gain map function; and adjusting the code values of a second group of image pixels according to a transition function that transitions from said gain map function to no gain at a maximum value point.

12. The method as described in claim 1 wherein said adjusting code values is related to a slope of a tone scale adjustment model.

13. The method as described in claim 1 wherein said adjusting code values is proportional to the ratio of the slope of a tone scale adjustment model at a point below an FTP and the slope of the tone scale adjustment model at a specific code value.

14. A method for display mode-dependent adjustment of image code values, said method comprising:

detecting a display mode for a display, wherein said display comprises a display source light and a plurality of light valves modulated to form a display image based on image code values of an input image and wherein said display mode relates to a source light illumination level for said display source light;

adjusting said source light to a first source light illumination level corresponding to said display mode when said display mode meets a first criterion;

applying a first tone scale adjustment model to code values of an input image to compensate for said adjusting said source light to said first source light illumination level when said display mode meets a first criterion; and adjusting said source light to a second source light illumination level corresponding to said display mode when said display mode meets a second criterion; and applying a second tone scale adjustment model to code values of said input image to compensate for said adjusting said to said second source light illumination level when said display mode meets said second criterion.

15. The method as described in claim 14 wherein said second tone scale adjustment model is a partial application of said first tone scale adjustment model.

16. An apparatus for display-mode-dependent adjustment of image code values, said apparatus comprising:

a display, wherein said display comprises a display source light and a plurality of light valves modulated to form a display image based on image code values of an input image and wherein said display comprises a plurality of display modes related to source light illumination levels for said display source light a detector for detecting a current display mode for said display;

a source light adjuster for adjusting said source light to a source light illumination level corresponding to said current display mode when said current display mode meets a criterion;

a tone scale adjustment model for adjusting image code values; and an image adjuster for adjusting code values in an input image to be displayed on said display using said current display mode and said source light illumination level such that said adjusting code values compensates for said adjusting said source light to said source light illumination level when said current display mode meets said criterion and wherein said adjusting code values comprises applying said tone scale adjustment model.

17. The apparatus as described in claim 16 wherein said adjusting code values with said tone scale adjustment model comprises applying a constant gain multiplier to a first range of code values and applying a roll-off curve to a second range of code values.

18. The apparatus as described in claim 16 wherein said adjusting code values with said tone scale adjustment model comprises applying a gain adjustment to a range of code values below an MFP point and applying a roll-off curve map to code values above said MFP point.

19. A method for display-mode-dependent, coordinated adjustment of image code values and a display source light, said method comprising:

detecting a display mode for a display, wherein said display comprises a display source light and a plurality of light valves modulated to form a display image based on image code values of an input image and wherein said display mode relates an input image content type and a corresponding source light illumination level for said display source light;

adjusting said source light to said source light illumination level corresponding to said display mode when said display mode meets a criterion; and adjusting code values in an input image to be displayed on said display using said display mode and said source light illumination level such that said adjusting code values compensates for said adjusting said source light to said source light illumination level by increasing code value brightness when said source light illumination level decreases, said adjusting code values occurring when said display mode meets said criterion.

20. The method as described in claim 19 wherein said adjusting code values comprises applying a tone scale adjustment model.

21. An apparatus for display mode-dependent, coordinated adjustment of image code values and a display source light illumination level, said apparatus comprising:

a display, wherein said display comprises a display source light and a plurality of light valves modulated to form a display image based on image code values of an input image and wherein said display employs a plurality of display modes related to input image content types and corresponding source light illumination levels for said display source light;

a detector for detecting a current display mode for said display;

a source light adjuster for adjusting said source light to a source light illumination level corresponding to said current display mode when said current display mode meets a criterion;

a tone scale adjustment model for adjusting image code values; and an image adjuster for adjusting code values in an input image to be displayed on said display using said current display mode and said source light illumination level such that said adjusting code values compensates for said adjusting said source light to said source light illumination level by increasing code value brightness when said source ht illumination level decreases said adjusting code values occurring when said current display mode meets said criterion and wherein said adjusting code values comprises applying said tone scale adjustment model.

* * * * *

UNITED STATES PATENT AND TRADEMARK OFFICE

CERTIFICATE OF CORRECTION

PATENT NO. : 8,947,465 B2
APPLICATION NO. : 11/293066
DATED : February 3, 2015
INVENTOR(S) : Louis Joseph Kerofsky It is certified that error appears in the above-identified patent and that said Letters Patent is hereby corrected as shown below:

In the Claims

Col. 17, Line 6, Claim 14,

Change "said to said" to read --said source light to said second source light--.

Col. 18, Line 44, Claim 21,

Change "ht" to read --light--.

Signed and Sealed this
Eighth Day of September, 2015

Michelle K. Lee

Michelle K. Lee
*Director of the United States Patent and Trademark Office*